US009885186B2

(12) United States Patent
Liu

(10) Patent No.: US 9,885,186 B2
(45) Date of Patent: Feb. 6, 2018

(54) JOINT STRUCTURE FOR ASSEMBLING FLOORBOARDS

(71) Applicant: Qianyi Liu, Guangzhou (CN)

(72) Inventor: Qianyi Liu, Guangzhou (CN)

( * ) Notice: Subject to any disclaimer, the term of this patent is extended or adjusted under 35 U.S.C. 154(b) by 0 days.

(21) Appl. No.: 15/173,589

(22) Filed: Jun. 3, 2016

(65) Prior Publication Data

US 2016/0281369 A1 Sep. 29, 2016

Related U.S. Application Data

(63) Continuation of application No. 13/950,312, filed on Jul. 25, 2013, now Pat. No. 9,371,653, which is a continuation-in-part of application No. PCT/CN2011/002131, filed on Dec. 19, 2011.

(30) Foreign Application Priority Data

Jan. 29, 2011 (CN) ..... 2011 1 0035241

(51) Int. Cl.
*E04F 15/02* (2006.01)

(52) U.S. Cl.
CPC .. *E04F 15/02038* (2013.01); *E04F 15/02033* (2013.01); *E04F 2201/013* (2013.01); *E04F 2201/0107* (2013.01); *E04F 2201/0138* (2013.01); *E04F 2201/025* (2013.01); *E04F 2201/0535* (2013.01)

(58) Field of Classification Search
CPC ..... E04F 15/02038; E04F 15/02033; E04F 2201/0107; E04F 2201/013; E04F 2201/025; E04F 2201/0535; E04F 2201/0138
USPC ..... 52/591.3, 592.2
See application file for complete search history.

(56) References Cited

U.S. PATENT DOCUMENTS 6,505,452 B1 * 1/2003 Hannig ..... B27F 1/04 52/582.1
7,600,354 B2 * 10/2009 Knauseder ..... E04F 15/02 52/578
8,037,656 B2 * 10/2011 Liu ..... E04F 15/02 52/589.1

(Continued)

FOREIGN PATENT DOCUMENTS

WO WO 2004048716 A1 * 6/2004 ..... E04F 15/02
WO WO 2010143962 A2 * 12/2010 ..... E04F 15/02

*Primary Examiner* — Adriana Figueroa
(74) *Attorney, Agent, or Firm* — Matthias Scholl, PC; Matthias Scholl

(57) ABSTRACT

A joint structure includes a first floorboard and a second floorboard. The first floorboard and the second floorboard each includes: a top surface; a bottom surface; a first side surface; a second side surface; a third side surface; a fourth side surface; a first beveled tenon, the first beveled tenon including a first tenon face facing upwards; a first beveled mortise, the first beveled mortise including a first mortise face facing upwards; a second beveled tenon, the second beveled tenon including a second tenon face facing downwards; and a second beveled mortise, the second beveled mortise including a second mortise face facing downwards. The top surface is disposed substantially parallel to the bottom surface. The first side surface, the second side surface, the third side surface, and the fourth side surface are disposed substantially perpendicular to the bottom surface.

2 Claims, 54 Drawing Sheets

(56) References Cited

U.S. PATENT DOCUMENTS

| | | | | |
|---|---|---|---|---|
| 8,038,363 | B2 * | 10/2011 | Hannig | B27F 1/04 403/339 |
| 8,191,334 | B2 * | 6/2012 | Braun | E04F 15/02 52/588.1 |
| 8,375,672 | B2 * | 2/2013 | Hannig | E04F 15/02038 52/588.1 |
| 2010/0218450 | A1 * | 9/2010 | Braun | E04F 15/02 52/588.1 |
| 2011/0131909 | A1 * | 6/2011 | Hannig | E04F 15/02 52/309.1 |
| 2011/0296780 | A1 * | 12/2011 | Windmoller | B32B 27/12 52/309.1 |

* cited by examiner

JOINT STRUCTURE FOR ASSEMBLING FLOORBOARDS

CROSS-REFERENCE TO RELATED APPLICATIONS

This application is a continuation of U.S. application Ser. No. 13/950,312 filed Jul. 25, 2013, now pending. U.S. application Ser. No. 13/950,312 filed Jul. 25, 2013, now pending, is a continuation-in-part of International Patent Application No. PCT/CN2011/002131 with an international filing date of Dec. 19, 2011, designating the United States, now pending, and further claims priority benefits to Chinese Patent Application No. 201110035241.6 filed Jan. 29, 2011. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to the field of building materials, and more particularly to a joint structure for assembling wood floorboards or composite floorboards.

Description of the Related Art

Typical joints used in floorboards include: a round tenon and round mortise joint, and a rectangular tenon and rectangular mortise joint. Assembly process of the round tenon and round mortise joint includes: rotating the round tenon to place the round tenon in the round mortise, placing the floorboards to a horizontal level so as to interlock the round tenon and the round mortise. The round tenon and round mortise joint is sealed and water-proof on a surface of the stitching line, however, seams cannot be sealed if errors occurs, and a base of the assembled joint is not water-proof or damp-proof. Assembly process of the rectangular tenon and rectangular mortise joint includes: inserting pins obliquely downwards from the rectangular mortise to fix a floorboard, and leaving an expansion joint for inserting a mounting piece. The assembly process for the rectangular tenon and rectangular mortise joint has tremendous and complicated procedures, but low assembly efficiency. Besides, the assembled floorboards cannot be recycled after being disassembled, so that the rectangular tenon and rectangular mortise joint tends to be discarded.

SUMMARY OF THE INVENTION

In view of the above-described problems, it is one objective of the invention to provide a joint structure for a floorboard that has simple assembly, rigid connection, and high strength, and is water-proof and damp-proof in top and bottom surfaces of the joint.

To achieve the above objective, in accordance with one embodiment of the invention, there is provided a joint structure comprising a first floorboard and a second floorboard. The first floorboard and the second floorboard each comprises: a top surface; a bottom surface; a first side surface; a second side surface; a third side surface; a fourth side surface; a first beveled tenon, the first beveled tenon comprising a first tenon face facing upwards; a first beveled mortise, the first beveled mortise comprising a first mortise face facing upwards; a second beveled tenon, the second beveled tenon comprising a second tenon face facing downwards; and a second beveled mortise, the second beveled mortise comprising a second mortise face facing downwards. The top surface is disposed substantially parallel to the bottom surface. The first side surface, the second side surface, the third side surface, and the fourth side surface are disposed substantially perpendicular to the bottom surface. The first side surface is disposed opposite to the second side surface; the third side surface is disposed opposite to the fourth side surface; the third side surface connects between the first side surface and the second side surface; and the fourth side surface connects between the first side surface and the second side surface. The first beveled tenon is disposed in parallel with the bottom surface and is disposed on the first side surface at approximately half a height of the first floorboard or the second floorboard; and the first beveled mortise is disposed at an inner side of the first beveled tenon. The second beveled tenon is disposed on the second side surface at approximately half the height of the first floorboard or the second floorboard; and the second beveled mortise is disposed at an inner side of the second beveled tenon. The first beveled tenon is adapted to fit with the second beveled mortise; and the second beveled tenon is adapted to fit with the first beveled mortise. An outer side of the first beveled tenon of the first floorboard and an inner side of the second beveled mortise of the second floorboard form a first interlock mechanism; and an outer side of the second beveled tenon of the first floorboard and an inner side of the first beveled mortise of the second floorboard form a second interlock mechanism. In assembling, the first beveled tenon and the first beveled mortise of the first floorboard match with the second beveled mortise and the second beveled tenon of the second floorboard, respectively; and the first floorboard and the second floorboard are further interlocked by the first interlock mechanism and the second interlock mechanism.

In accordance with another embodiment of the invention, there is provided a joint structure comprising a first floorboard and a second floorboard. The first floorboard and the second floorboard each comprises: a top surface; a bottom surface; a first side surface; a second side surface; a third side surface; a fourth side surface; a first beveled tenon, the first beveled tenon comprising a first tenon face facing outwards; a first beveled mortise, the first beveled mortise comprising a first mortise face facing outwards; a second beveled tenon, the second beveled tenon comprising a second tenon face facing outwards; and a second beveled mortise, the second beveled mortise comprising a second mortise face facing outwards. The top surface is disposed substantially parallel to the bottom surface. The first side surface, the second side surface, the third side surface, and the fourth side surface are disposed substantially perpendicular to the bottom surface. The first side surface is disposed opposite to the second side surface; the third side surface is disposed opposite to the fourth side surface; the third side surface connects between the first side surface and the second side surface; and the fourth side surface connects between the first side surface and the second side surface. The first beveled tenon is disposed in perpendicular to the bottom surface and is disposed on the first side surface at approximately half a height of the first floorboard or the second floorboard; and the first beveled mortise is disposed at an inner side of the first beveled tenon. The second beveled tenon is disposed on the second side surface at approximately half the height of the first floorboard or the second floorboard; and the second beveled mortise is disposed at an inner side of the second beveled tenon. The first beveled tenon is adapted to fit with the second beveled mortise; and the second beveled tenon is adapted to fit with the first beveled mortise. An outer side of the first beveled tenon of the first floorboard and an inner side of the second beveled mortise of the second floorboard form a first interlock mechanism; and an outer side of the second beveled tenon of the first floorboard and an inner side of the first beveled mortise of the second floorboard form a second interlock mechanism. In assembling, the first beveled tenon and the first beveled mortise of the first floorboard match with the second beveled mortise and the second beveled tenon of the second floorboard, respectively; and the first floorboard and the second floorboard are further interlocked by the first interlock mechanism and the second interlock mechanism.

In accordance with still another embodiment of the invention, there is provided with a joint structure for a floorboard, comprising: at least one first curved tenon, the first curved tenon comprising a tenon face facing outwards; a first curved mortise, the first curved mortise comprising a mortise face facing outwards; at least one second curved tenon, the second curved tenon comprising a tenon face facing outwards; and a second curved mortise, the second curved mortise comprising a mortise face facing outwards. The first curved tenon is disposed inclined to a surface of the floorboard at a right edge approximately half a height of the floorboard. The first curved mortise is disposed at an inner side of the first curved tenon. The second curved tenon is disposed at a left edge approximately half the height of the floorboard. The second curved mortise is disposed at an inner side of the second curved tenon. The first curved tenon matches with the second curved mortise. The second curved tenon matches with the first curved mortise. An outer side of the first curved tenon and an inner side of the second curved mortise form a first interlock mechanism. An outer side of the second curved tenon and an inner side of the first curved mortise form a second interlock mechanism. In assembling, the first curved tenon and the first curved mortise of a first floorboard match with the second curved mortise and the second curved tenon of a second floorboard, respectively; and the two floorboards are further interlocked by the first interlock mechanism and the second interlock mechanism.

In a class of this embodiment, the second interlock mechanism is formed by arranging tooth-shaped tenons respectively on the inner side of the first beveled mortise and the outer side of the second beveled tenon, allowing a tooth top line and a tooth bottom line of each of the tooth-shaped tenons to be in parallel with the surface of the floorboard, and engaging the two tooth-shaped tenons with each other. The first interlock mechanism is formed by arranging tooth-shaped tenons respectively on the outer side of the first beveled tenon and the inner side of the second beveled mortise, allowing a tooth top line and a tooth bottom line of each of the tooth-shaped tenons to be in parallel with the surface of the floorboard, and engaging the two tooth-shaped tenons with each other.

In a class of this embodiment, the second interlock mechanism is formed by arranging a first trapezoidal blind mortise on the inner side of the first beveled mortise and a first trapezoidal tenon on the outer side of the second beveled tenon, respectively, and matching the first trapezoidal blind mortise and the first trapezoidal tenon with each other. The first interlock mechanism is formed by arranging a second trapezoidal tenon on the outer side of the first beveled tenon and a second trapezoidal blind mortise on the inner side of the second beveled mortise, respectively, and matching the second trapezoidal blind mortise and the second trapezoidal tenon with each other.

In a class of this embodiment, a first deformation structure is formed between the first trapezoidal tenon and corresponding side surface of the floorboard; and a second deformation structure is formed between the second trapezoidal tenon and corresponding side surface of the floorboard. Each of the first deformation structure and the second deformation structure comprises: a triangular ridge comprising a sharp edge and two additional edges, or a rectangular ridge comprising a sharp edge and three additional edges. The sharp edge leans against a beveled line of the first trapezoidal blind mortise or the second trapezoidal blind mortise so as to form a line contact. An expansion joint is formed between the two additional edges of the triangular ridge or the three additional edges of the rectangular ridge for avoiding contact.

Because the expansion joint is designed, it is not required to insert a sandwich piece, thereby saving the assembly time. Besides, the beveled tenon-and-mortise joint provides the floorboard with a highly integrative structure, so that the fixation by inserting pins are avoided, which further saving the time and the production cost. The deformation structure is designed for solving problems resulting from the natural expansion of the floorboard.

The interlock mechanism is not limited to the above structures, it is a structure comprising a rectangular tenon and a rectangular blind mortise, or a structure comprising a miter tenon and a rectangular corner.

In a class of this embodiment, the floorboard comprises: a front edge comprising a straight tenon on an upper part and a straight blind mortise on a lower part; and a rear edge comprising a straight blind mortise on an upper part and a straight tenon on a lower part.

In the process of assembling the floorboards, dovetail tenon-and-mortise joint are added on two ends that are intersected with the ends provided with the beveled tenon-and-mortise joint so as to increase the strength in a direction in perpendicularity to a grain. Dovetail mortises are arranged on the upper part and the lower part of each of the front edge and the rear edge of the first floorboard and the second floorboard; and each of the dovetail mortise is provided with the dovetail tenon strip.

In a class of this embodiment, the first beveled tenon and the second beveled tenon have the same slope. One or more beveled tenon-and-mortise joints are provided.

To assemble floorboards employing the joint structure and using the tooth-shaped tenon or the trapezoidal tenon-and-blind mortise as the interlock mechanism, place the beveled tenon of the first floorboard in the beveled mortise of the second floorboard, push the beveled tenon from a relatively wide beveled mortise to a relatively narrower beveled mortise so as to fix the beveled tenon inside the beveled mortise; meanwhile, further interlock the two floorboards by the interlock mechanism of the he tooth-shaped tenon or the interlock mechanism of the trapezoidal tenon-and-blind mortise so as to effectively prevent the boards from splitting in the joint part. Because the base of the joint part overlaps with one another, the base is damp-proof. Floorboards of such structure are capable of forming a rigid integrative structure and preventing the floorboards from falling apart. The up-down connected part is sealed, thereby being damp-proof. No swell and few contraction of the floorboard will happen after long term use. The joint has a simple structure, convenient assembly, which is very suitable for assembling wood floorboards and composite floorboards.

Advantages of the invention are as follows:

1) when used in decorative wall panels, the assembly process using the joint structure is simple and time saving; the assembled decorative wall panels has completely sealed stitching lines, high integration, no nail holes or exposed screws, and seam splitting resulting from retraction of the floorboard is prevented.
2) when used in light weight building walls, the use of the joint structure is capable of saving a large amount of keels for fixing internal joints.
3) when used in water proof wall panels used in wooden building. The joint structure of the invention is capable of largely increasing the air impermeability (energy saving) and the strength of the integrative structure (wind resistant and shock resistant).
4) A paint treatment on the joint position can prevent the formation of the joint splitting.
5) The use of the joint of the invention is suitable to cut panels of large area into small pieces so as to save packing materials and the transporting space, which meets the requirements of environmental protection.
6) The joint structure of the invention decreases the use of the pins and assembly process thereof, and meanwhile the gluing is saved.
7) When the joint structure is used in furniture, the use of the hardware and glue can be largely decreased. The integrative structure is transformed from a conventional point stress structure into a line stress structure, thereby improving the duration of the whole furniture, omitting the gluing process, simplifying the assembly and disassembly, and meeting the requirements of environmental protection.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a joint structure for assembling floorboards are described below. It should be noted that the following examples are intended to describe and not to limit the invention.

Figure 1:
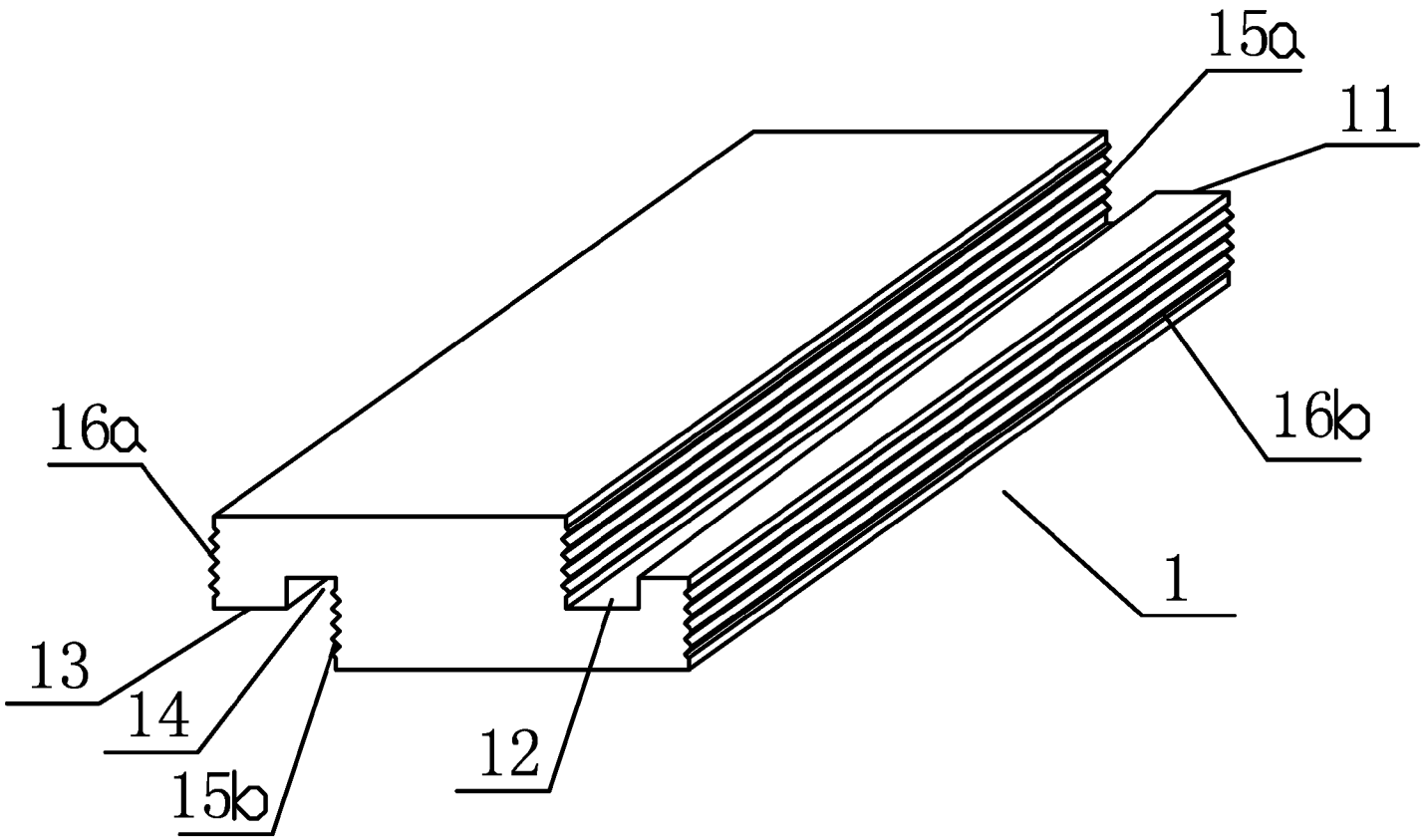
FIG. 1 is a structure diagram of a floorboard comprising a tenon-and mortise-joint in accordance with one embodiment of the invention.
Figure 2:
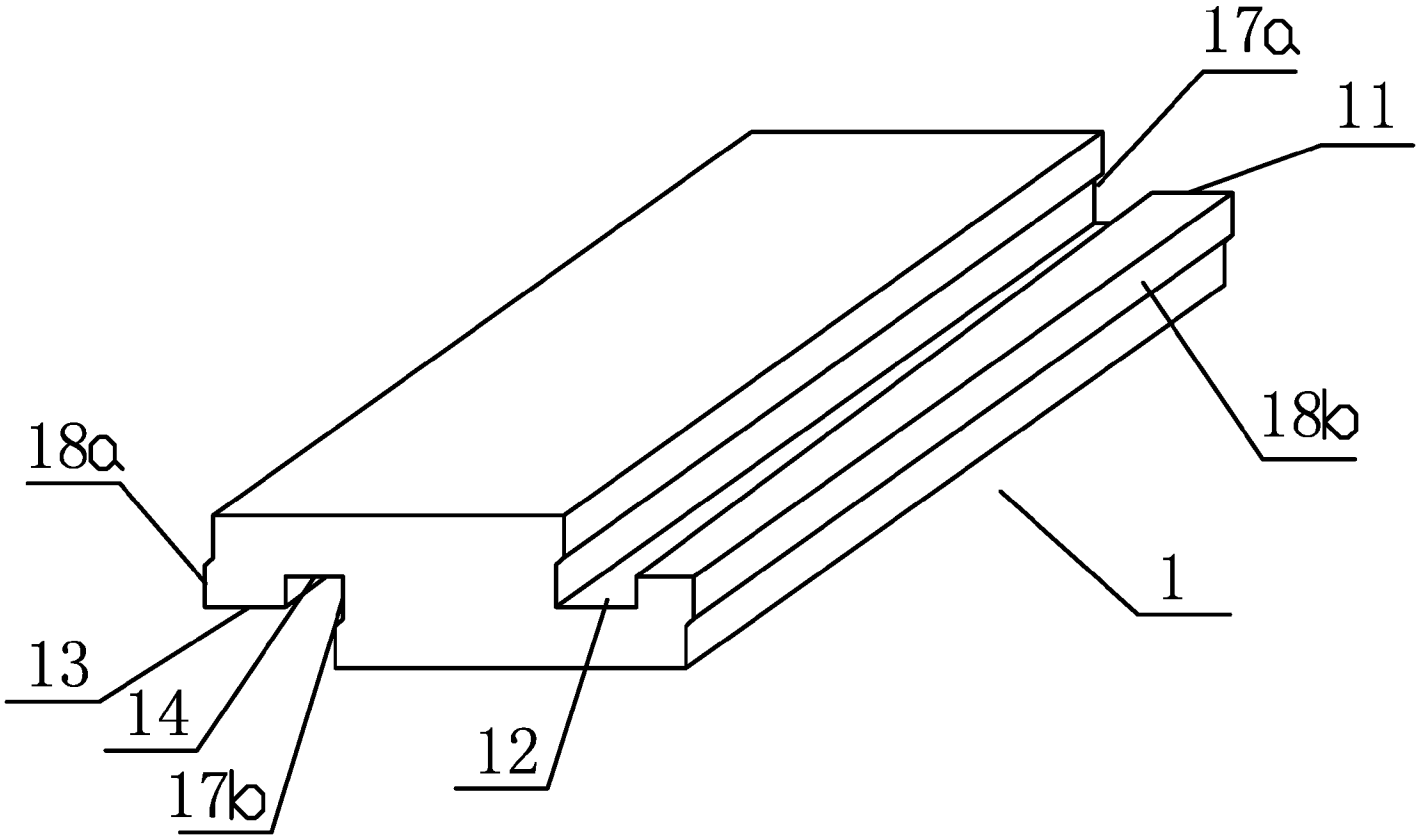
FIG. 2 is a structure diagram of a floorboard comprising a tenon-and mortise-joint in accordance with one embodiment of the invention.
Figure 3:
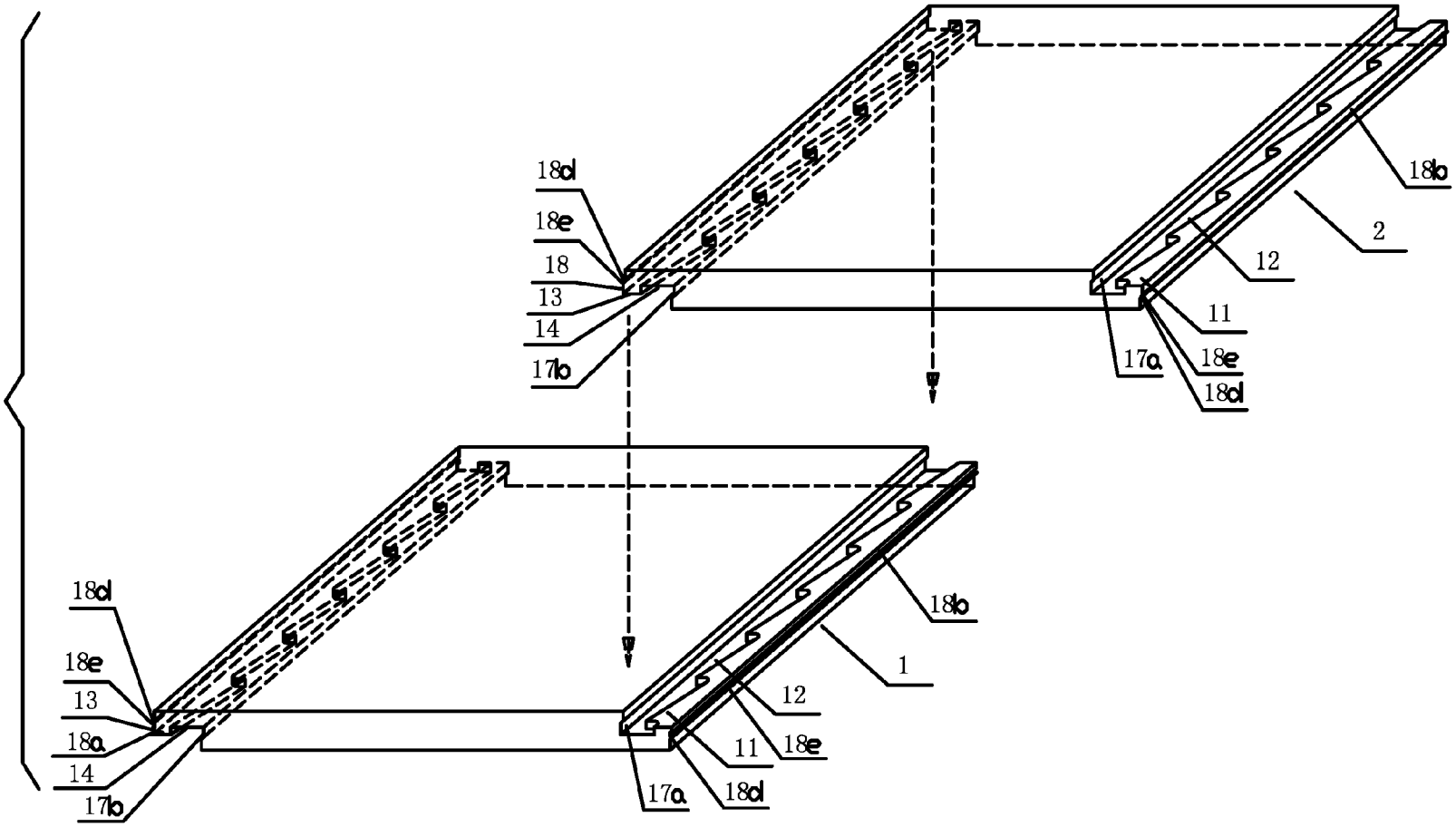
FIG. 3 is an axonometric drawing of hardwood floorboards comprising a plurality of beveled tenon-and-mortise joints in accordance with one embodiment of the invention.

As shown in FIGS. 1-3, a joint structure for a floorboard, comprises: at least one first beveled tenon 11, the first beveled tenon 11 comprising a tenon face facing upwards; a first beveled mortise 12, the first beveled mortise 12 comprising a mortise face facing upwards; at least one second beveled tenon 13, the second beveled tenon 13 comprising a tenon face facing downwards; and a second beveled mortise 14, the second beveled mortise 14 comprising a mortise face facing downwards. The first beveled tenon 11 is disposed in parallel to a surface of the floorboard at a right edge approximately half a height of the floorboard. The first beveled mortise 12 is disposed at an inner side of the first beveled tenon 11. The second beveled tenon 13 is disposed at a left edge approximately half the height of the floorboard. The second beveled mortise 14 is disposed at an inner side of the second beveled tenon 13. The first beveled tenon 11 matches with the second beveled mortise 14. The second beveled tenon 13 matches with the first beveled mortise 12. An outer side of the first beveled tenon 11 and an inner side of the second beveled mortise 14 form a first interlock mechanism. An outer side of the second beveled tenon 13 and an inner side of the first beveled mortise 12 form a second interlock mechanism. In assembling, the first beveled tenon 11 and the first beveled mortise 12 of a first floorboard 1 match with the second beveled mortise 14 and the second beveled tenon 13 of a second floorboard 2, respectively; and the two floorboards are further interlocked by the first interlock mechanism and the second interlock mechanism.

As shown in FIG. 1, the second interlock mechanism is formed by arranging tooth-shaped tenons 15*a*, 16*a* respectively on the inner side of the first beveled mortise 12 and the outer side of the second beveled tenon 13, allowing a tooth top line and a tooth bottom line of each of the tooth-shaped tenons 15*a*, 16*a* to be in parallel with the surface of the floorboard, and engaging the two tooth-shaped tenons 15*a*, 16*a* with each other. The first interlock mechanism is formed by arranging tooth-shaped tenons 16*b*, 15*b* respectively on the outer side of the first beveled tenon 11 and the inner side of the second beveled mortise 14, allowing a tooth top line and a tooth bottom line of each of the tooth-shaped tenons 15*b*, 16*b* to be in parallel with the surface of the floorboard, and engaging the two tooth-shaped tenons 15*b*, 16*b* with each other. The first beveled tenon 11 and the first beveled mortise 12 of the first floorboard 1 match with the second beveled mortise 14 and the second beveled tenon 13 of the second floorboard 2, respectively; and the two floorboards are further interlocked and clamped by the first interlock mechanism and the second interlock mechanism.

As shown in FIG. 2, the second interlock mechanism is formed by arranging a trapezoidal blind mortise 17*a* on the inner side of the first beveled mortise 12 and a trapezoidal tenon 18*a* on the outer side of the second beveled tenon 13, respectively, and matching the trapezoidal blind mortise 17*a* and the trapezoidal tenon 18*a* with each other. The first interlock mechanism is formed by arranging the trapezoidal tenon 18*b* on the outer side of the first beveled tenon 11 and a trapezoidal blind mortise 17*b* on the inner side of the second beveled mortise 14, respectively, and matching the trapezoidal blind mortise 17*b* and the trapezoidal tenon 18*b* with each other. The first beveled tenon 11 and the first beveled mortise 12 of the first floorboard 1 match with the second beveled mortise 14 and the second beveled tenon 13 of the second floorboard 2, respectively; and the two floorboards are further interlocked and clamped by the first interlock mechanism and the second interlock mechanism.

Figure 4:
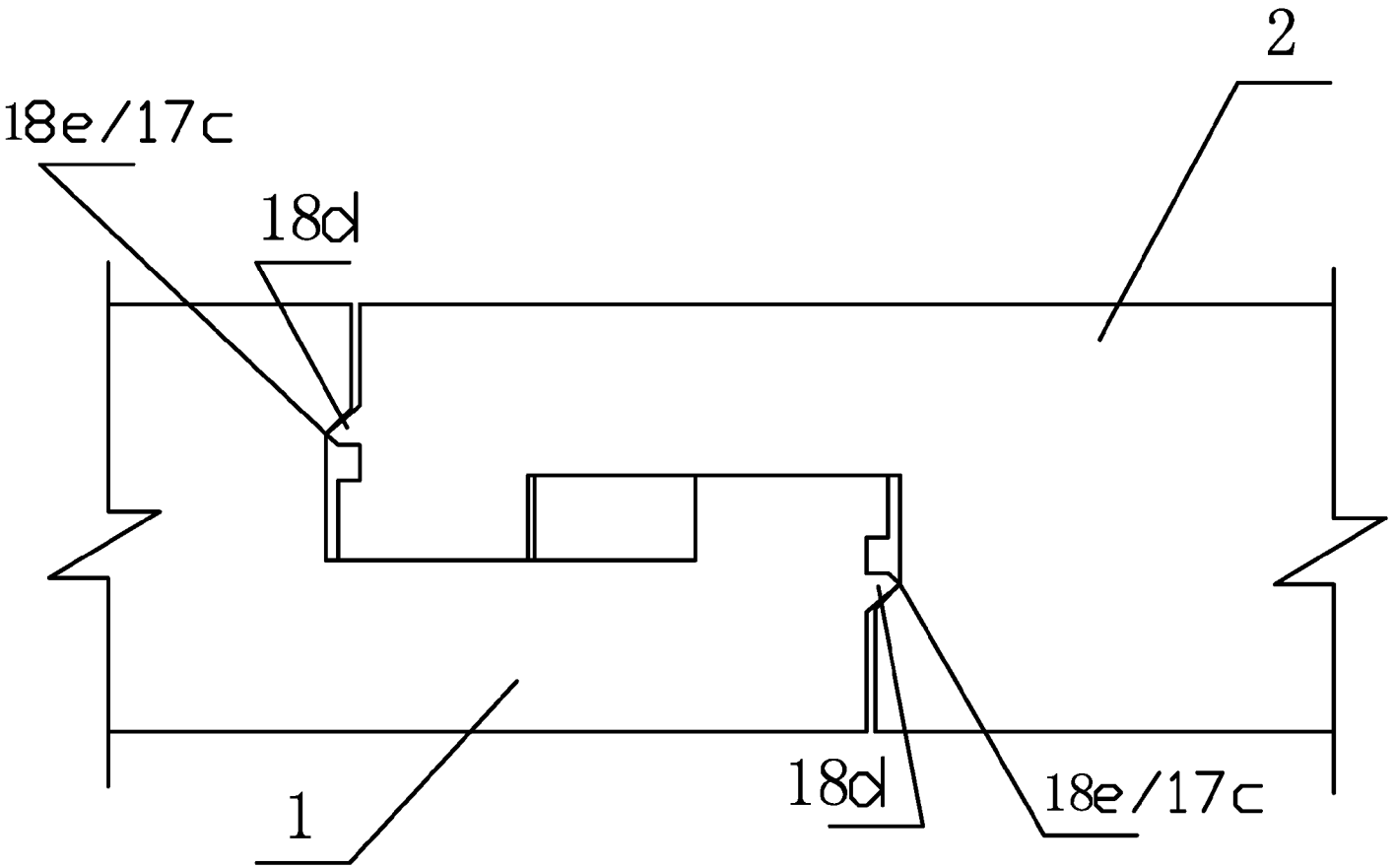
FIG. 4 is an enlarged view of a deformation structure of assembled hardwood floorboards of FIG. 3 in accordance with one embodiment of the invention.
Figure 5:
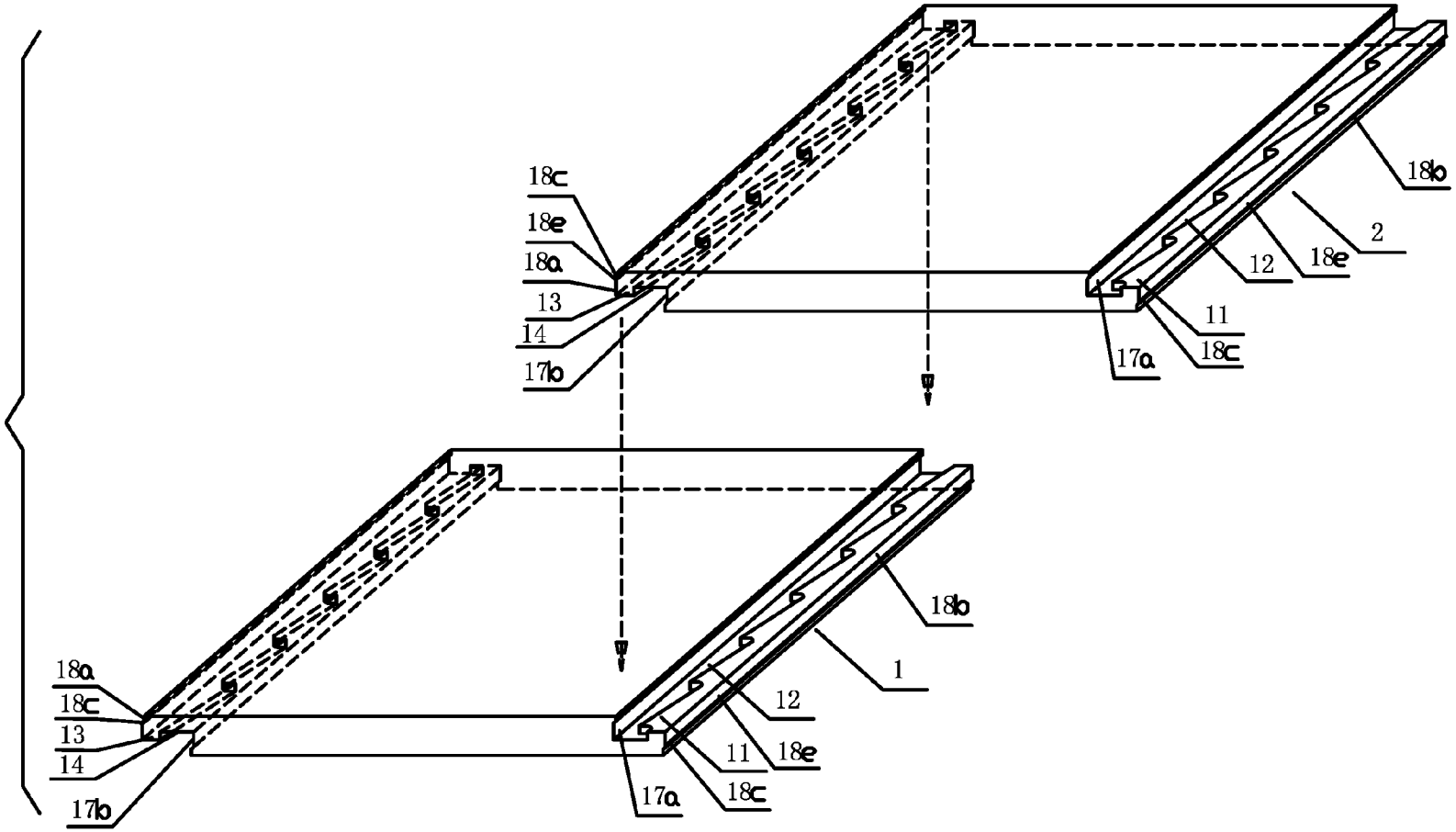
FIG. 5 is an axonometric drawing of softwood floorboards comprising a plurality of beveled tenon-and-mortise joints in accordance with one embodiment of the invention.
Figure 6:
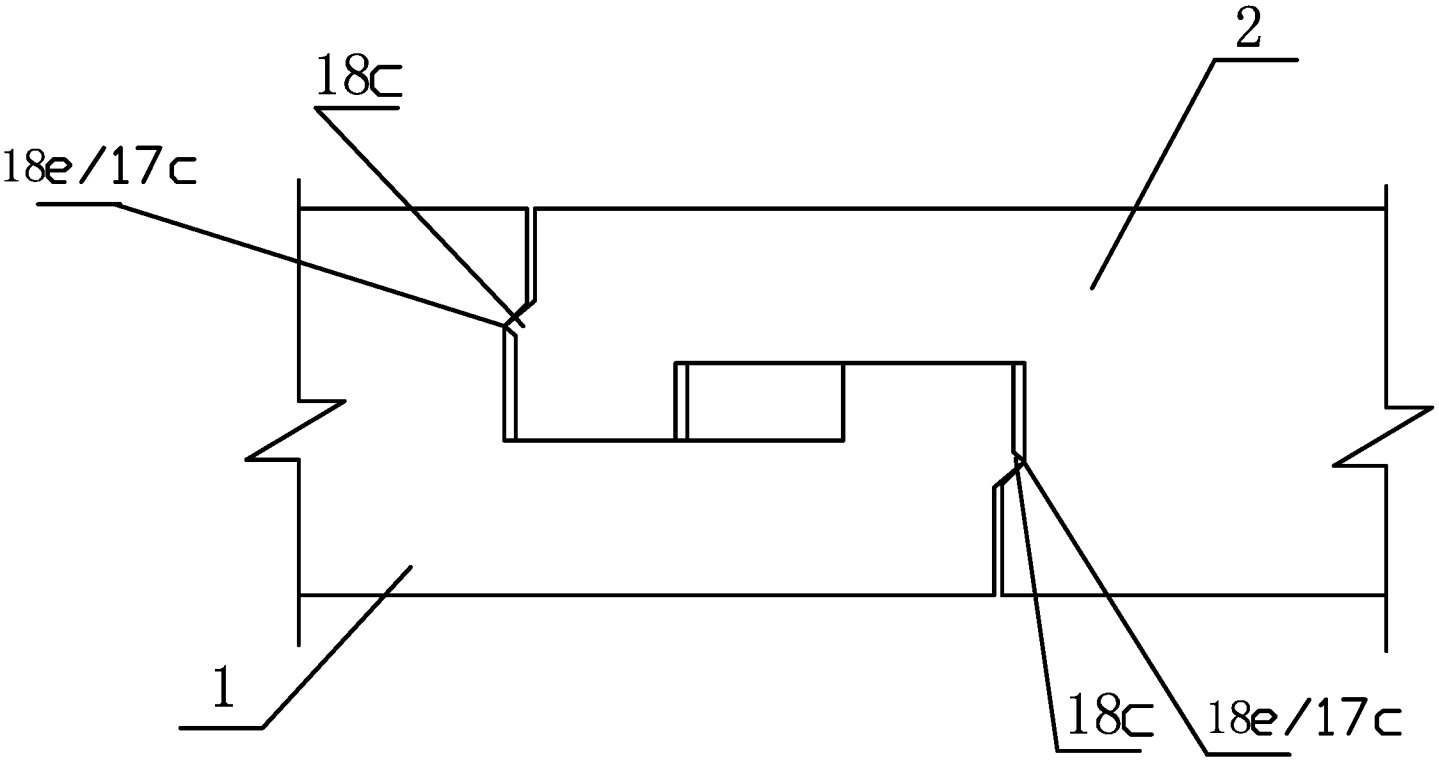
FIG. 6 is an enlarged view of a deformation structure of assembled softwood floorboards of FIG. 5 in accordance with one embodiment of the invention.

To avoid swell phenomenon between the trapezoidal blind mortise 17*a*, 17*b* and the trapezoidal tenon 18*b*, 18*a*, a deformation structure is designed. The deformation structures is formed between the trapezoidal tenon 18*b*, 18*a* arranged on the outer side of either the first tenon 11 or the second tenon 13, and corresponding edge of the floorboard. A deformation structure comprises: a triangular ridge 18*c* comprising a sharp edge 18*e* (as shown in FIGS. 3-4), or a rectangular ridge 18*d* comprising a sharp edge 18*e* (as shown in FIGS. 5-6). The sharp edge 18*e* leans against a beveled line 17*c* of the trapezoidal blind mortise 17*b* so as to form a line contact. An expansion joint is formed between the other two sides of the triangular ridge 18*c* or the other three sides of the rectangular ridge 18*d* for avoiding contact.

Figure 7:
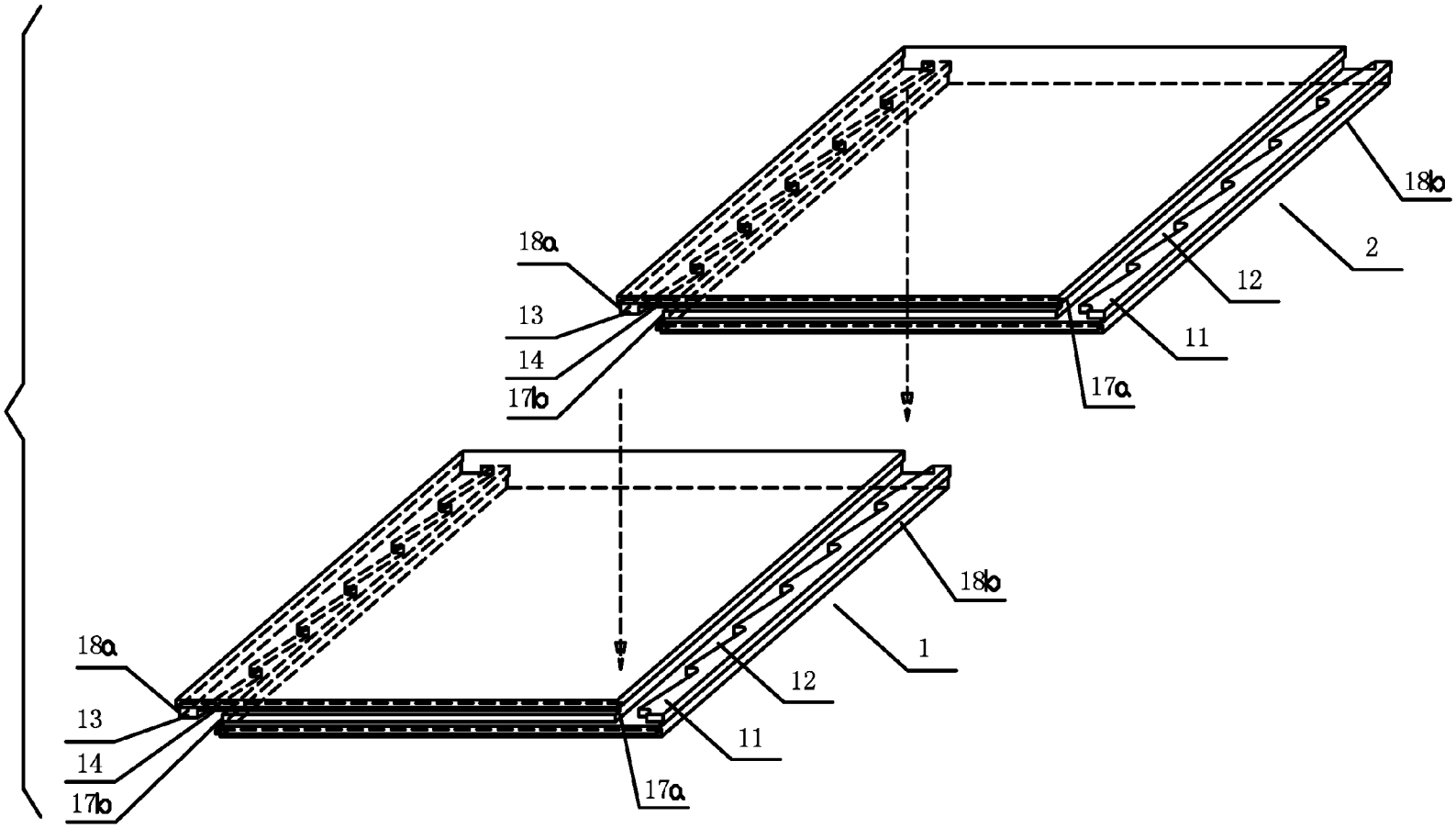
FIG. 7 is an axonometric drawing of two floorboards to be assembled in accordance with one embodiment of the invention.

In the process of assembly the floorboards, dovetail tenon-and-mortise joint are added on two ends that are intersected with the ends provided with the beveled tenon-and-mortise joint so as to increase the strength in a direction in perpendicularity to a grain. As shown in FIG. 7, dovetail mortises 23 are arranged on the upper part and the lower part of each of the front edge and the rear edge of the first floorboard 1 and the second floorboard 2; and each of the dovetail mortises 23 is provided with the dovetail tenon strip 24.

The interlock mechanism can be other structures, such as a structure comprising a rectangular tenon and a rectangular blind mortise, and a structure comprising a sharp corner-tenon and a rectangular sharp corner.

One or more beveled tenons and beveled mortises matched with each other can be designed. As shown in FIG. 3, the invention comprises a plurality of beveled tenons and corresponding mortises that have the same slope. The structure comprising the trapezoidal blind mortise and the trapezoidal tenon is employed.

Figure 8:
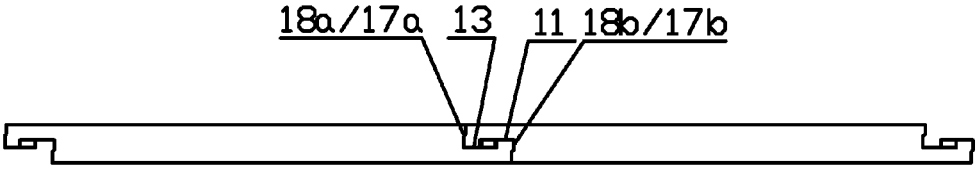
FIG. 8 is a laterally sectional view of two floorboards to be assembled in accordance with one embodiment of the invention.

FIG. 8 is a lateral view of assembled two floorboards.

Figure 9:
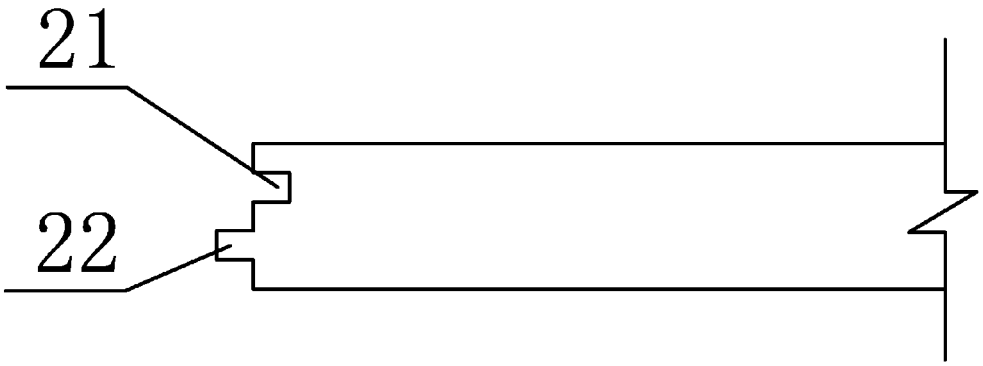
FIG. 9 is a cross sectional view of a floorboard end comprising a lower straight tenon and an upper straight mortise in accordance with one embodiment of the invention.
Figure 10:
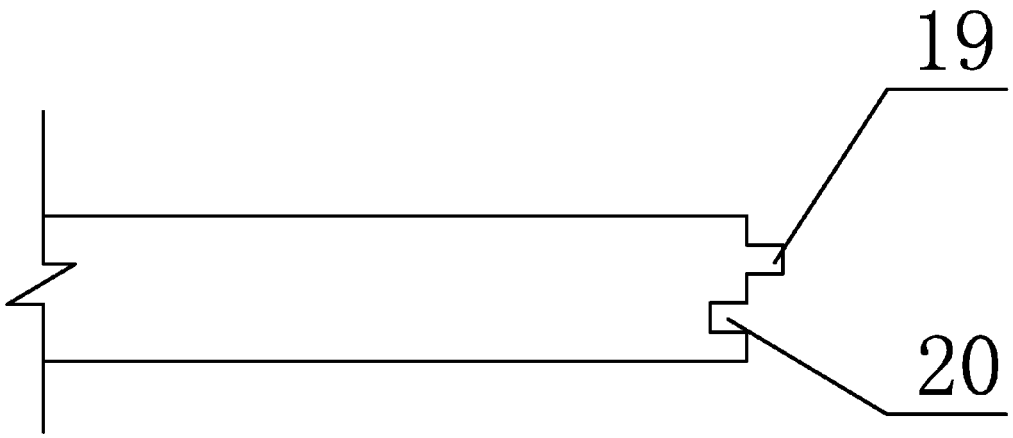
FIG. 10 is a cross sectional view of a floorboard end comprising a lower straight mortise and an upper straight tenon in accordance with one embodiment of the invention.

As shown in FIGS. 9-10, the floorboard comprises: a front edge comprising a straight tenon 19 on an upper part and a straight blind mortise 21 on a lower part; and a rear edge comprising a straight blind mortise 21 on an upper part and a straight tenon 19 on a lower part.

Figure 11:
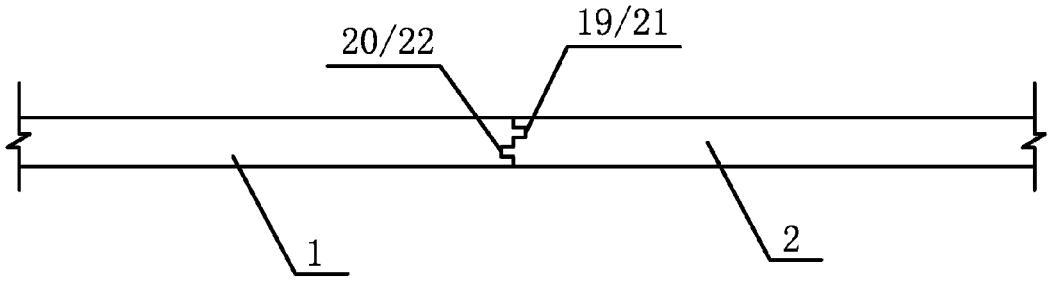
FIG. 11 is a laterally sectional view of two assembled floorboards in accordance with one embodiment of the invention.

FIG. 11 is a laterally sectional view of two assembled floorboards.

Figure 12:
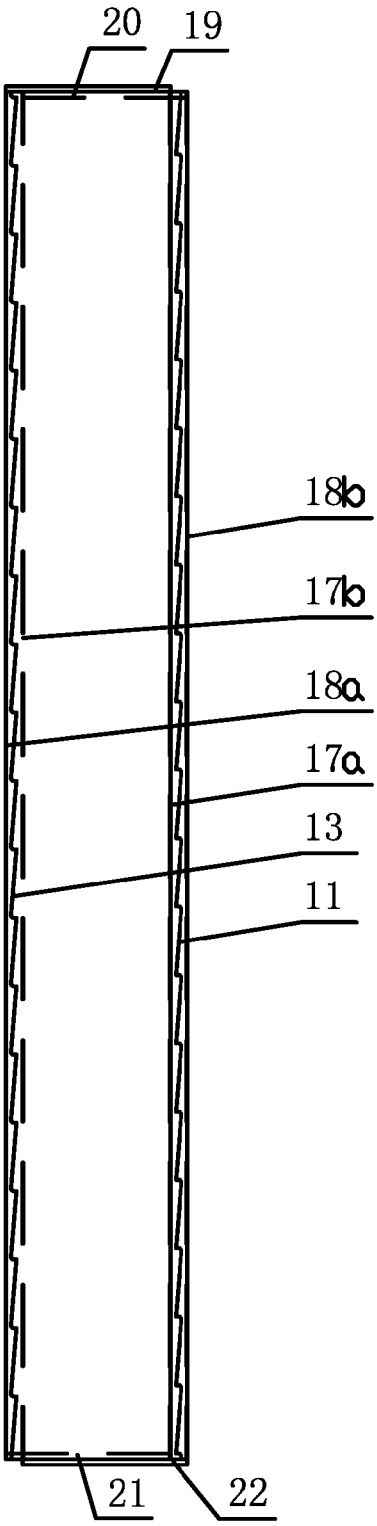
FIG. 12 is a top view of a floorboard in accordance with one embodiment of the invention.

FIG. 12 is a top view of a floorboard.

Figure 13:
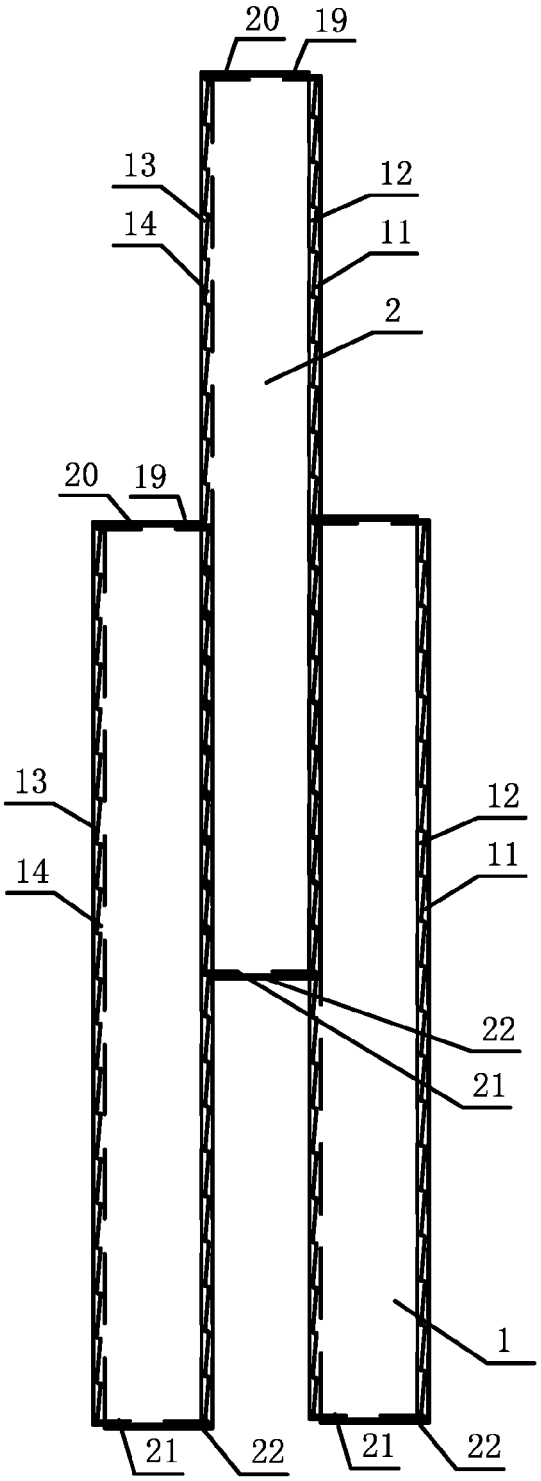
FIG. 13 is a top view of assembled floorboards in accordance with one embodiment of the invention.

FIG. 13 is a top view of assembled floorboards.

Figure 14:
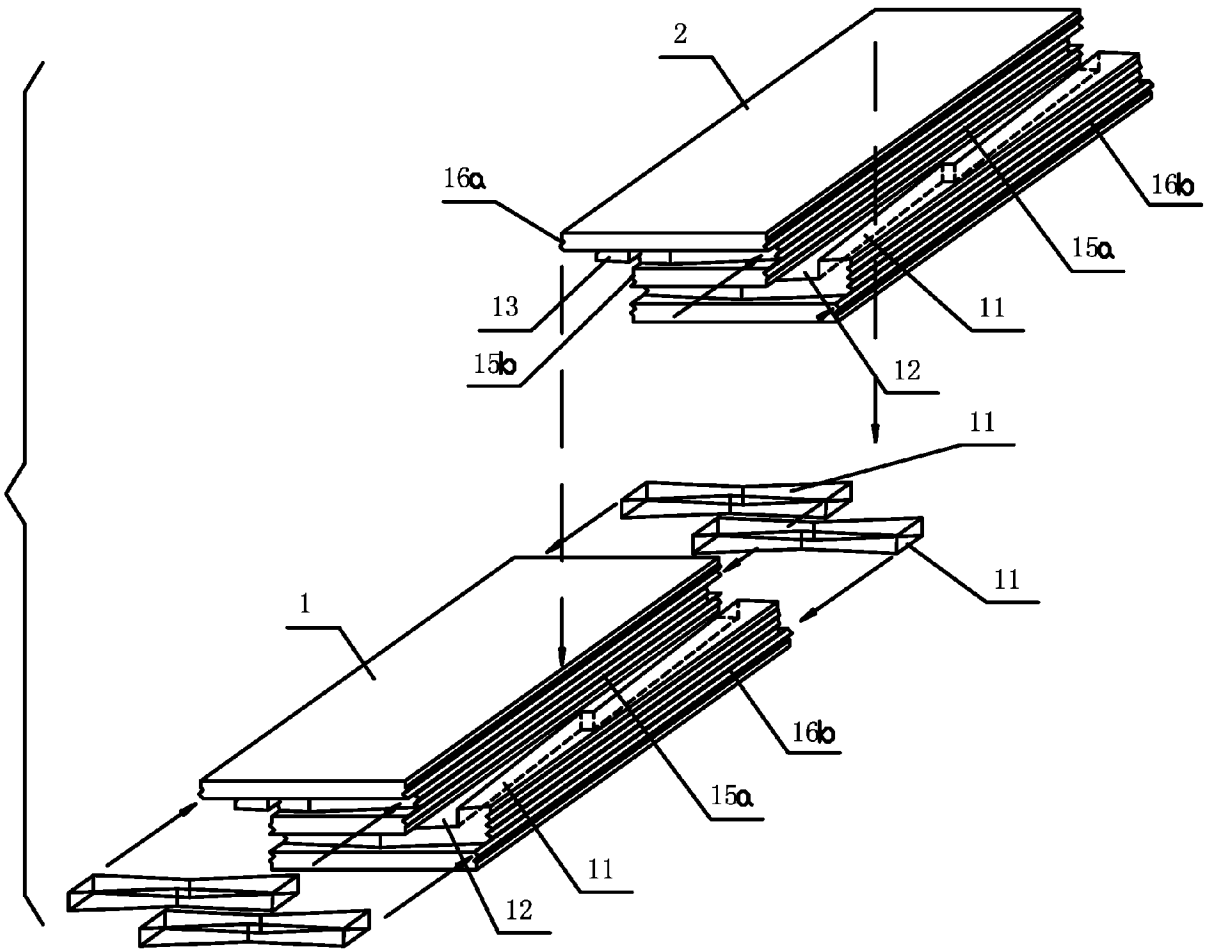
FIG. 14 is an axonometric drawing of veneers comprising beveled tenon-and-mortise joints before assembly in accordance with one embodiment of the invention.

The joint of the invention can used to assemble veneers, an axonometric drawing of veneers comprising beveled tenon-and-mortise joints before assembly is shown in FIG. 14.

Figure 15:
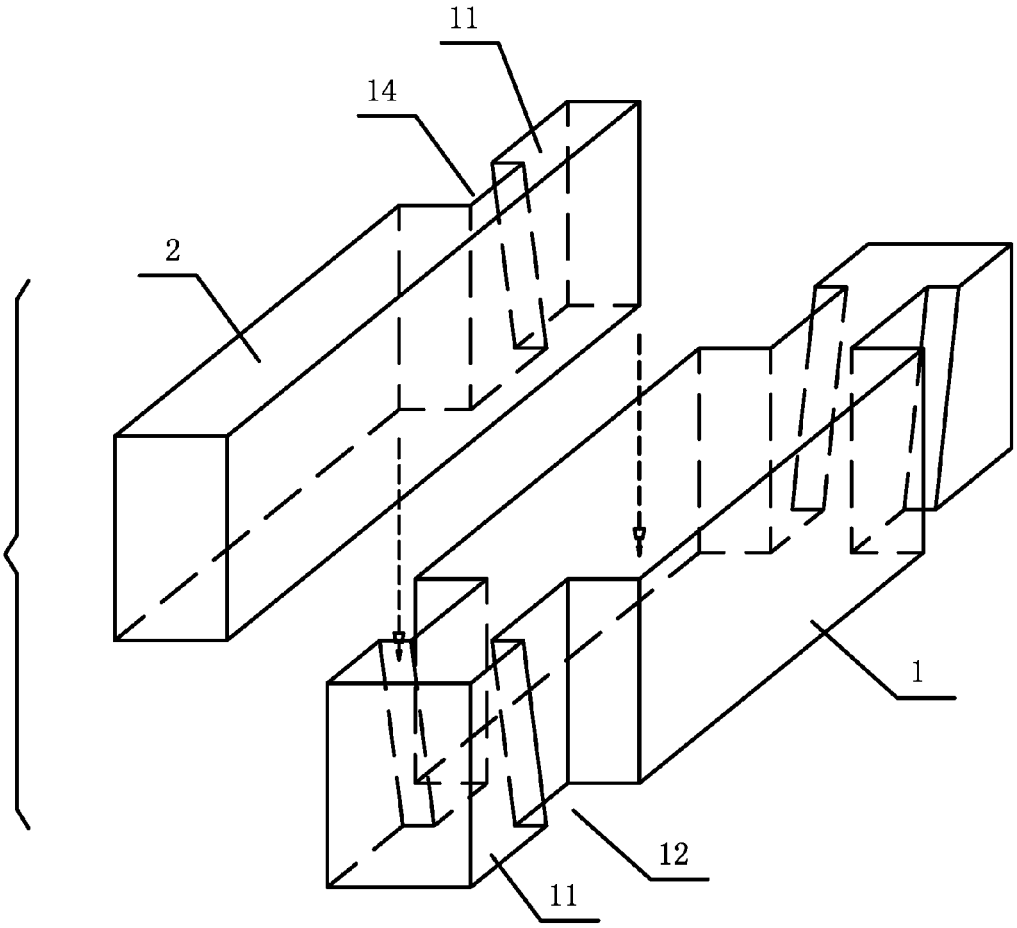
FIG. 15 is a structure diagram of planks comprising beveled tenon-and-mortise joints before assembly in accordance with one embodiment of the invention.
Figure 16:
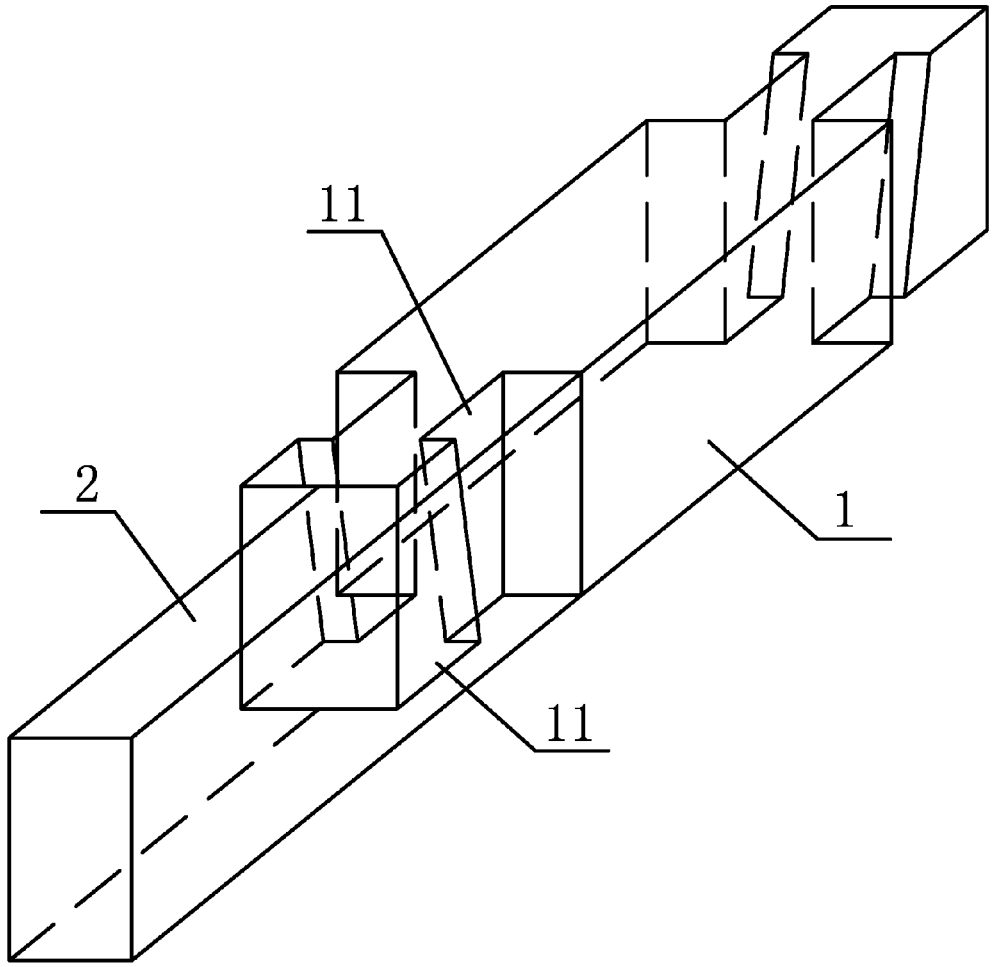
FIG. 16 is a structure diagram of planks comprising beveled tenon-and-mortise joints after assembly in accordance with one embodiment of the invention.
Figure 17:
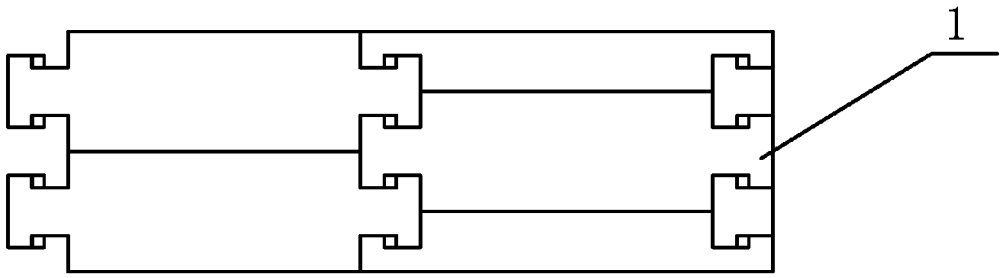
FIG. 17 is a top view of planks comprising beveled tenon-and-mortise joints after assembly in accordance with one embodiment of the invention.
Figure 18:
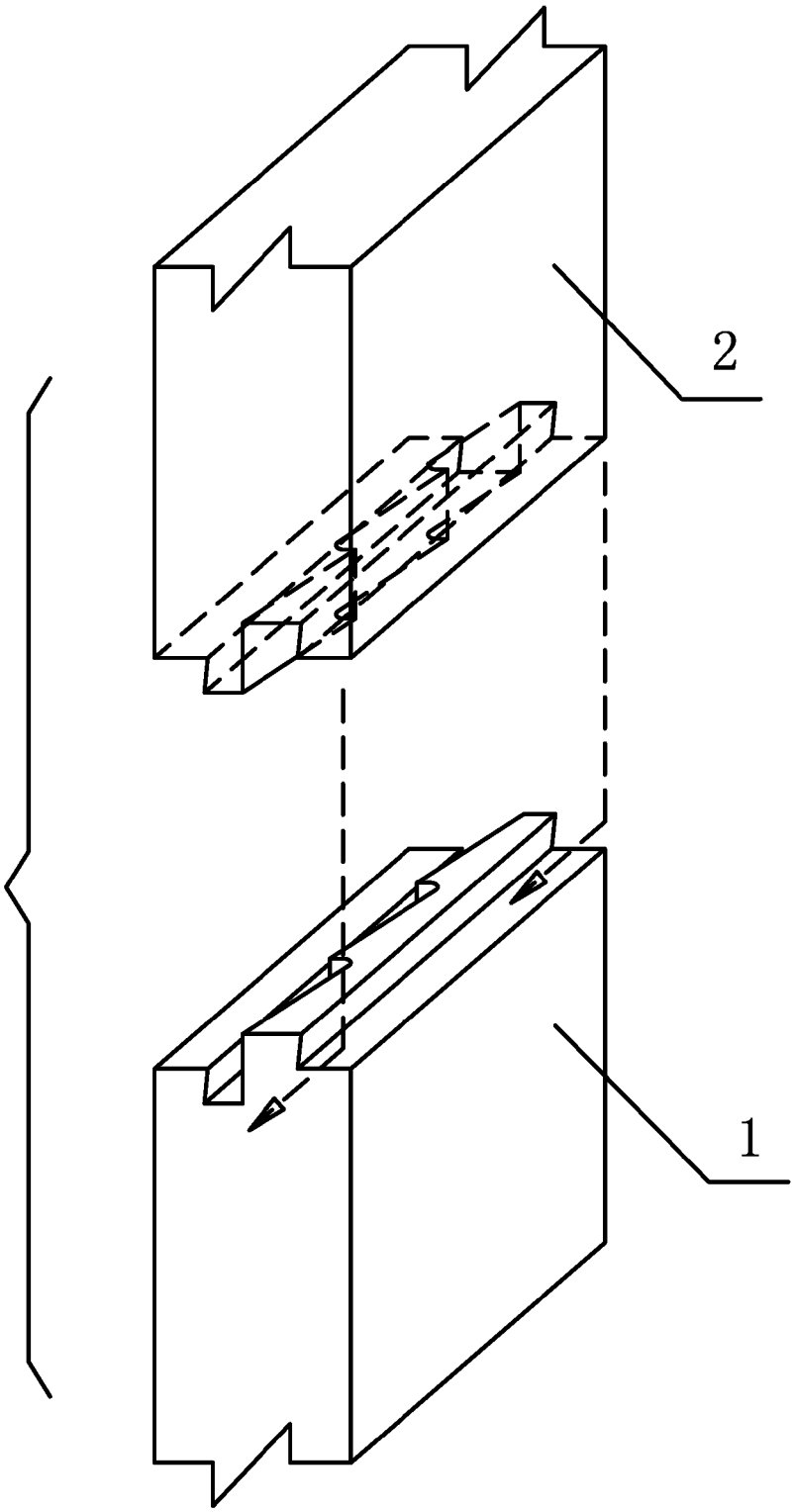
FIG. 18 is a structure diagram of floorboards comprising beveled tenon-and-mortise joints in perpendicularity to the floorboards before assembly in accordance with one embodiment of the invention.
Figure 19:
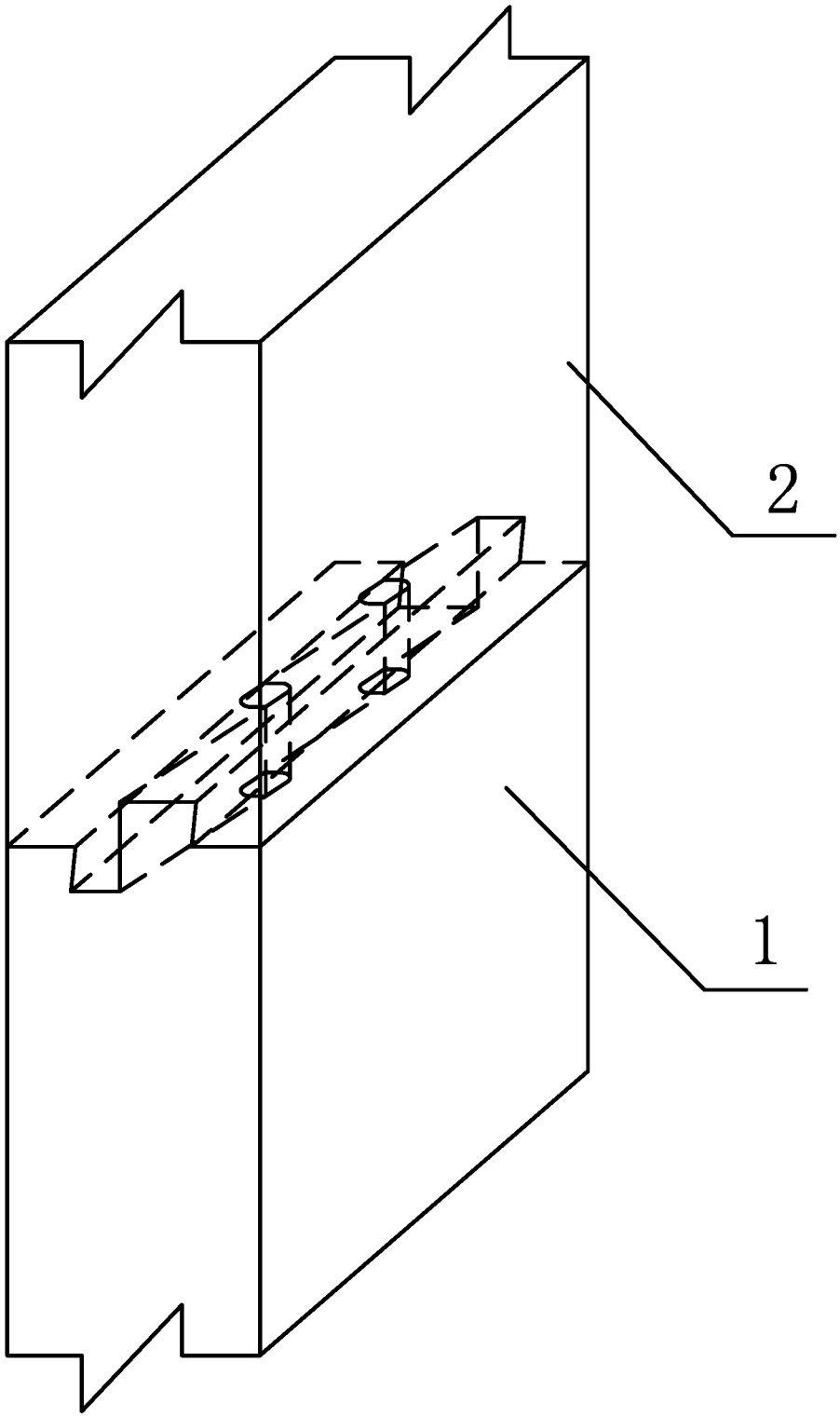
FIG. 19 is a structure diagram of floorboards comprising beveled tenon-and-mortise joints in perpendicularity to the floorboards after assembly in accordance with one embodiment of the invention.
Figure 20:
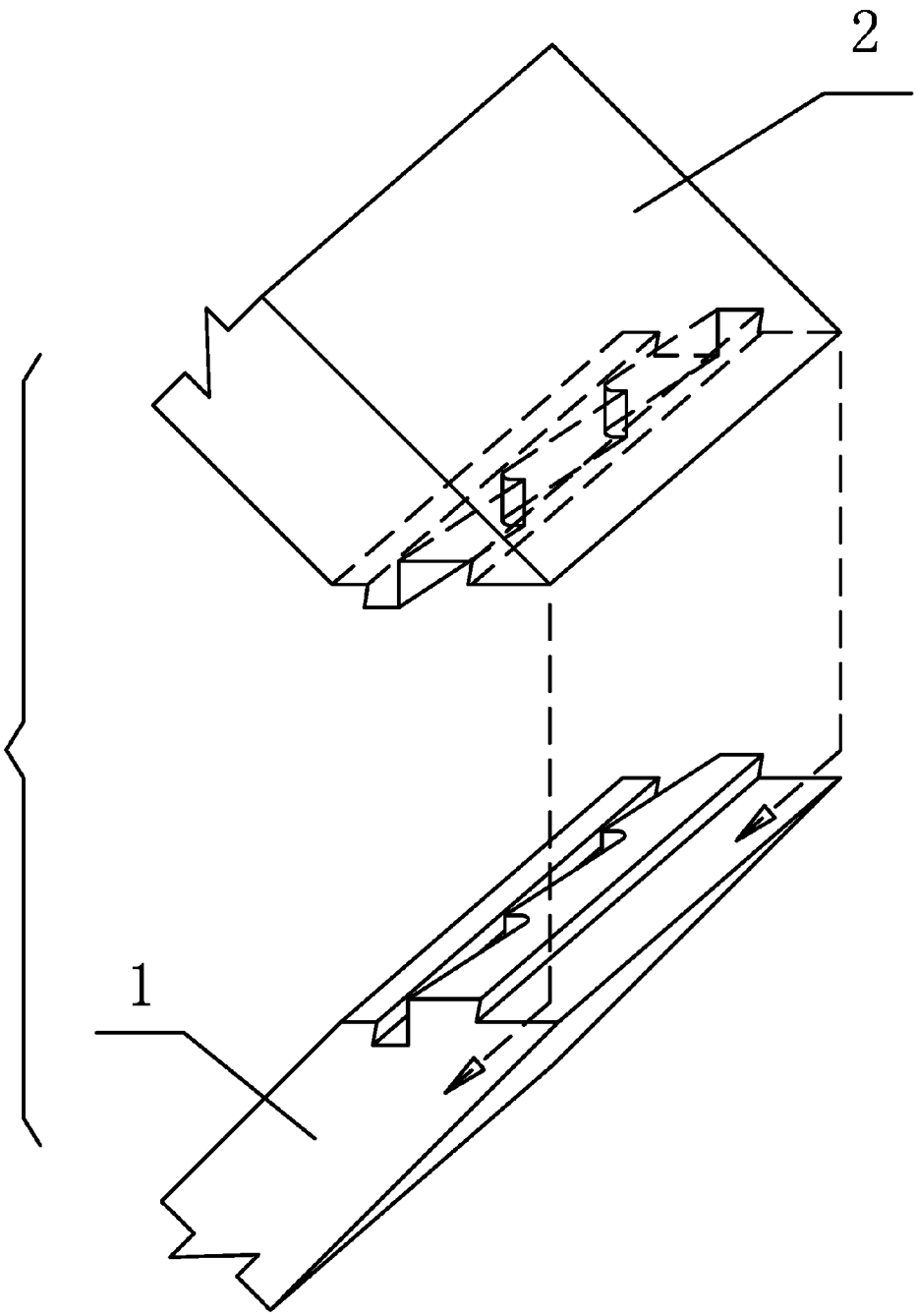
FIG. 20 is a structure diagram of floorboards comprising beveled tenon-and-mortise joints at an angle of 45° to the floorboards before assembly in accordance with one embodiment of the invention.
Figure 21:
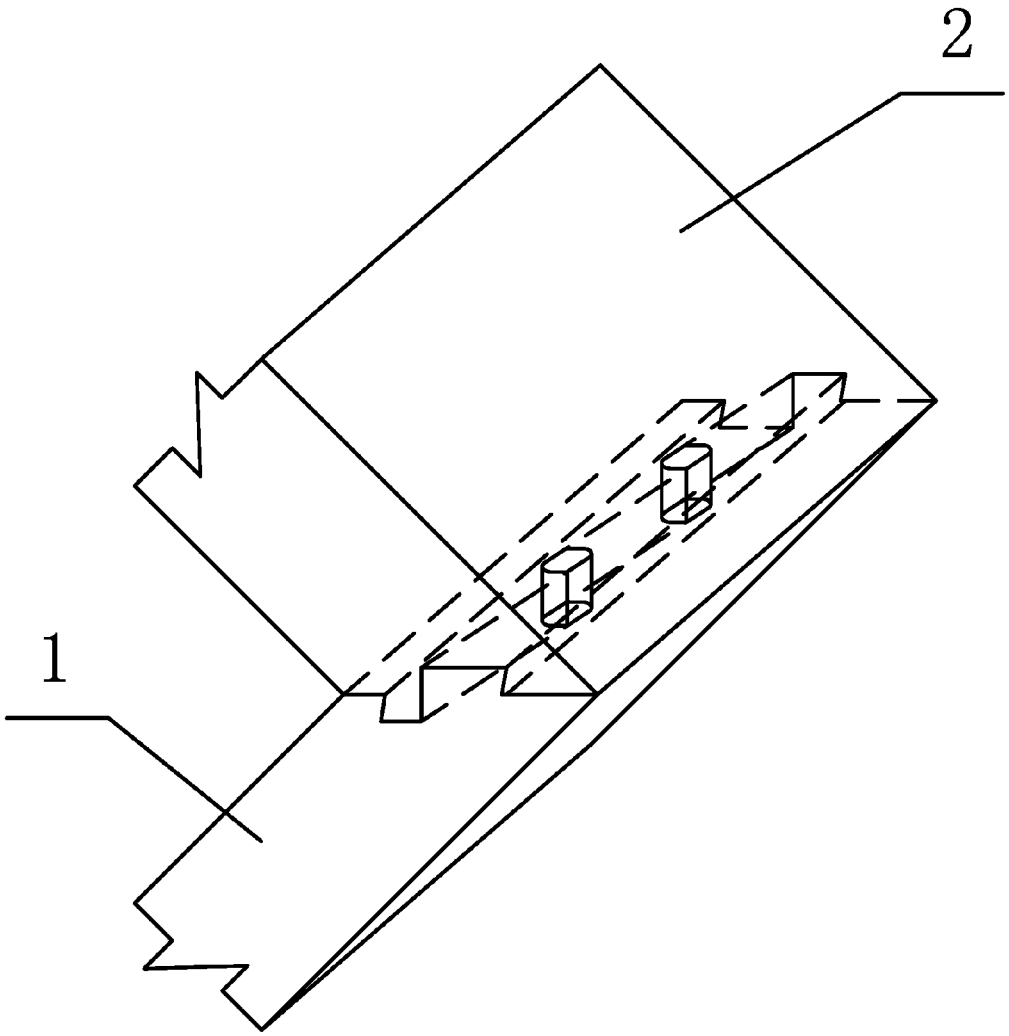
FIG. 21 is a structure diagram of floorboards comprising beveled tenon-and-mortise joints at an angle of 45° to the floorboards before assembly in accordance with one embodiment of the invention.
Figure 22:
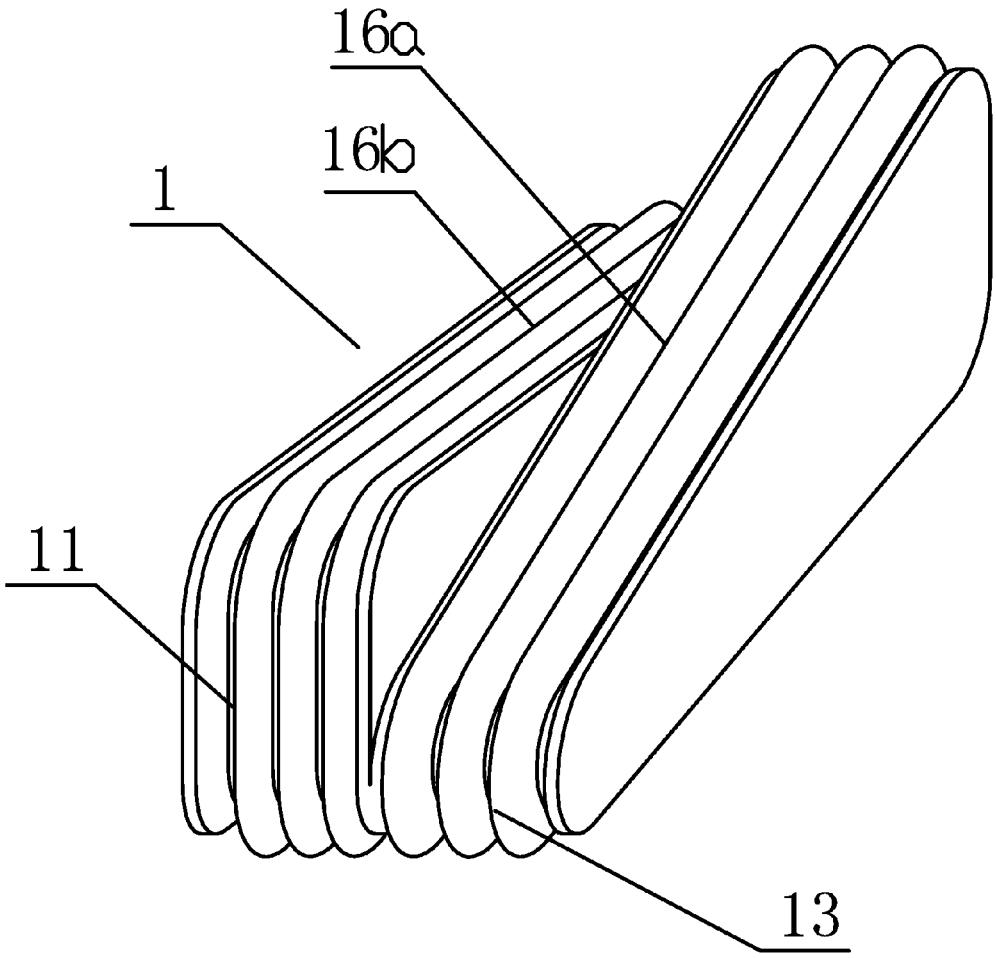
FIG. 22 is a structure diagram of a tooth-shaped tenon in accordance with one embodiment of the invention.
Figure 23:
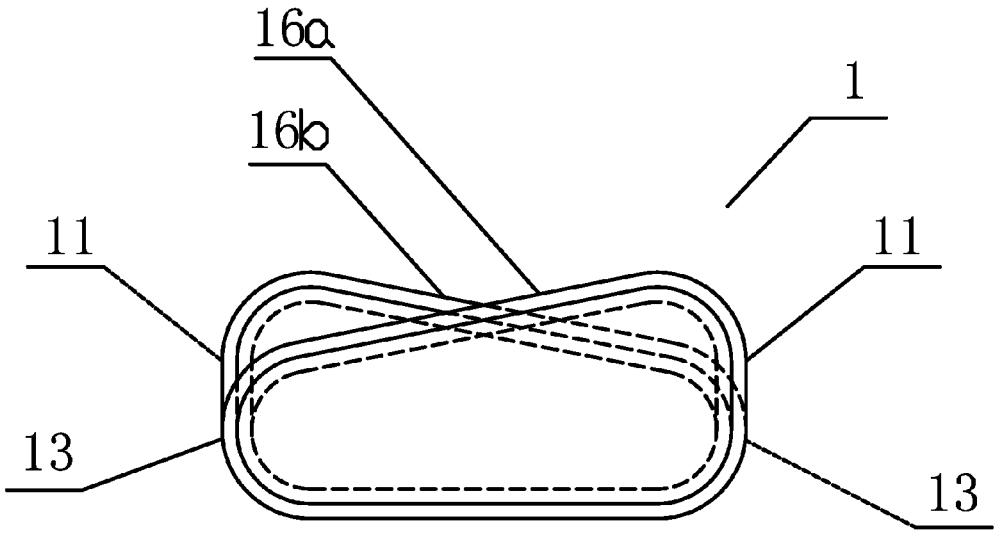
FIG. 23 is a front view of a tooth-shaped tenon of FIG. 1 in accordance with one embodiment of the invention.
Figure 24:
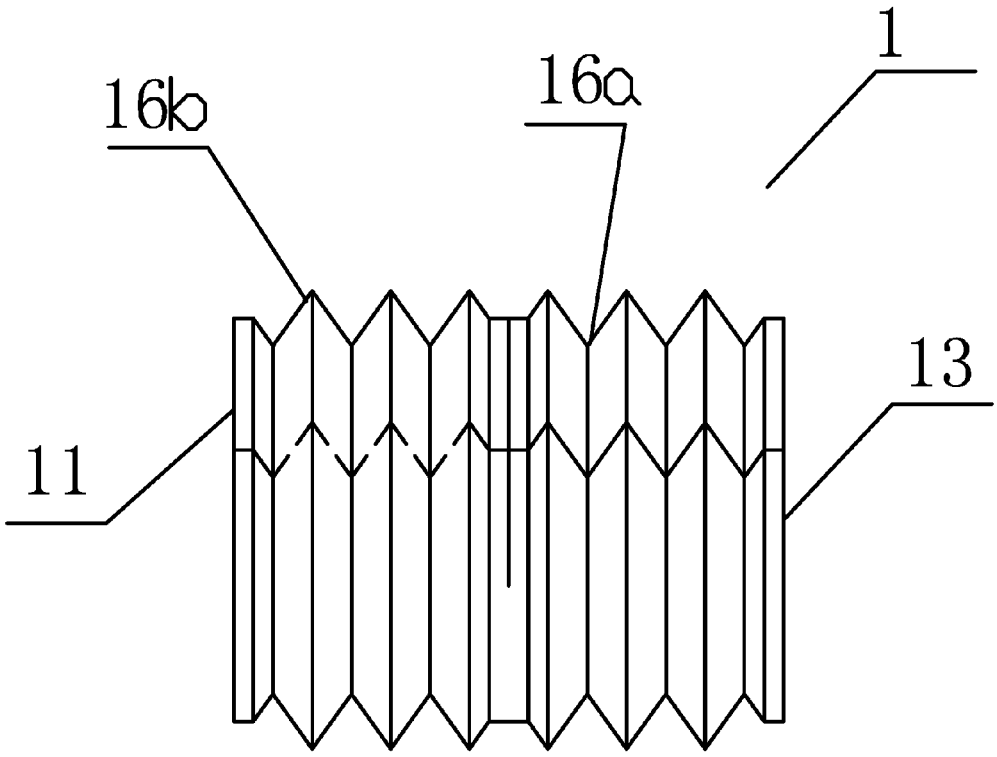
FIG. 24 is a lateral view of a tooth-shaped tenon of FIG. 1 in accordance with one embodiment of the invention.
Figure 25:
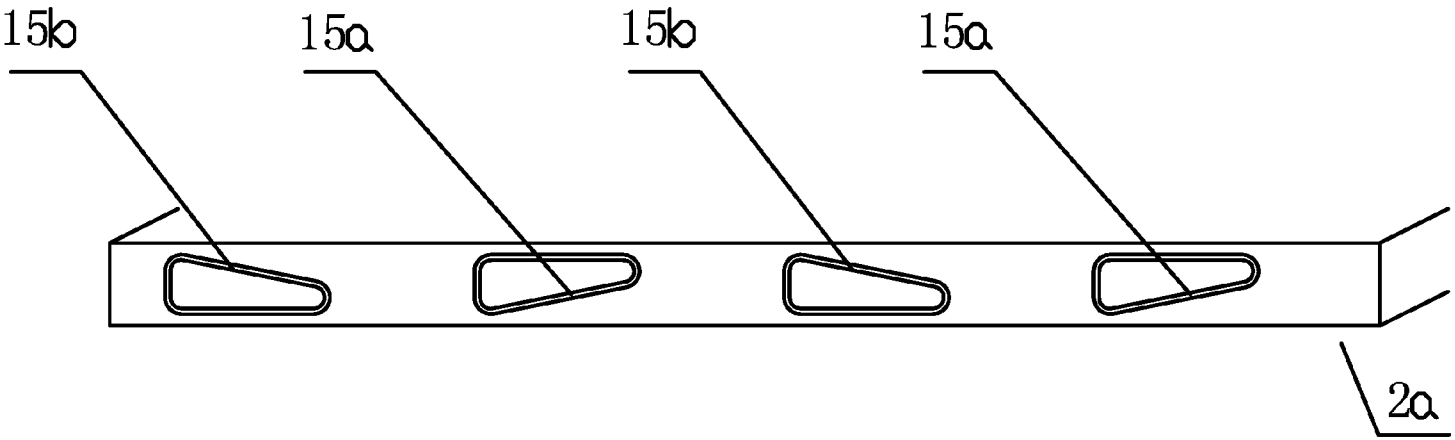
FIG. 25 is a structure diagram of a connecting member comprising a groove fitting with a tooth-shaped tenon in accordance with one embodiment of the invention.
Figure 26:
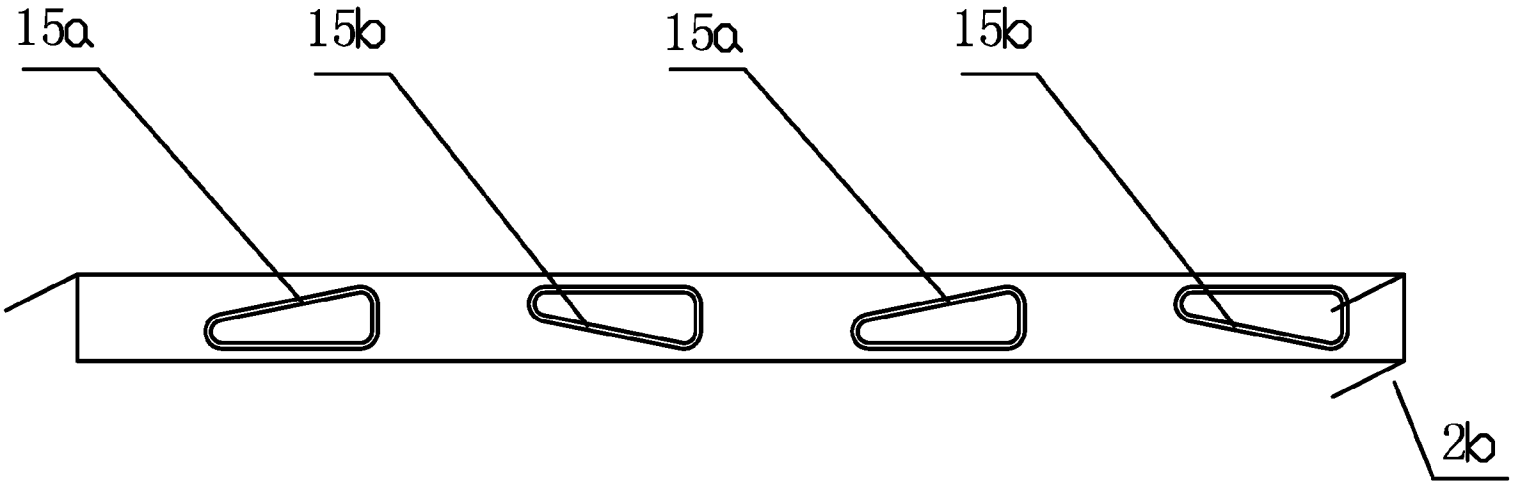
FIG. 26 is a structure diagram of another connecting member comprising a groove fitting with a tooth-shaped tenon in accordance with one embodiment of the invention.
Figure 27:
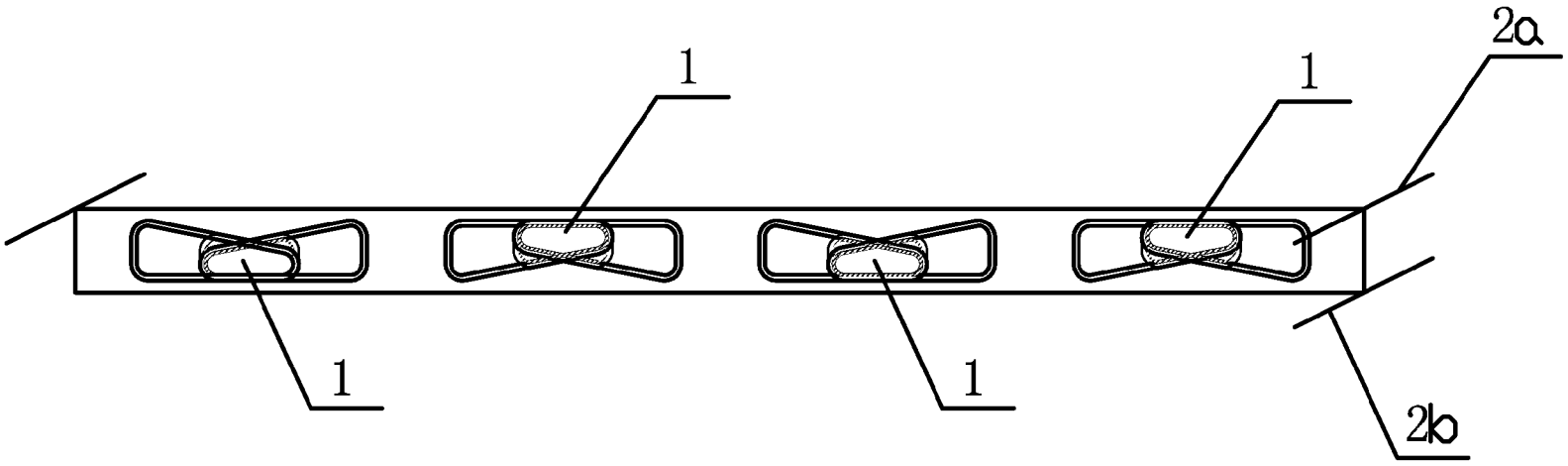
FIG. 27 is a structure diagram of connecting members of FIGS. 25-26 assembled by a tooth-shaped tenon of FIG. 22 in accordance with one embodiment of the invention.
Figure 28:
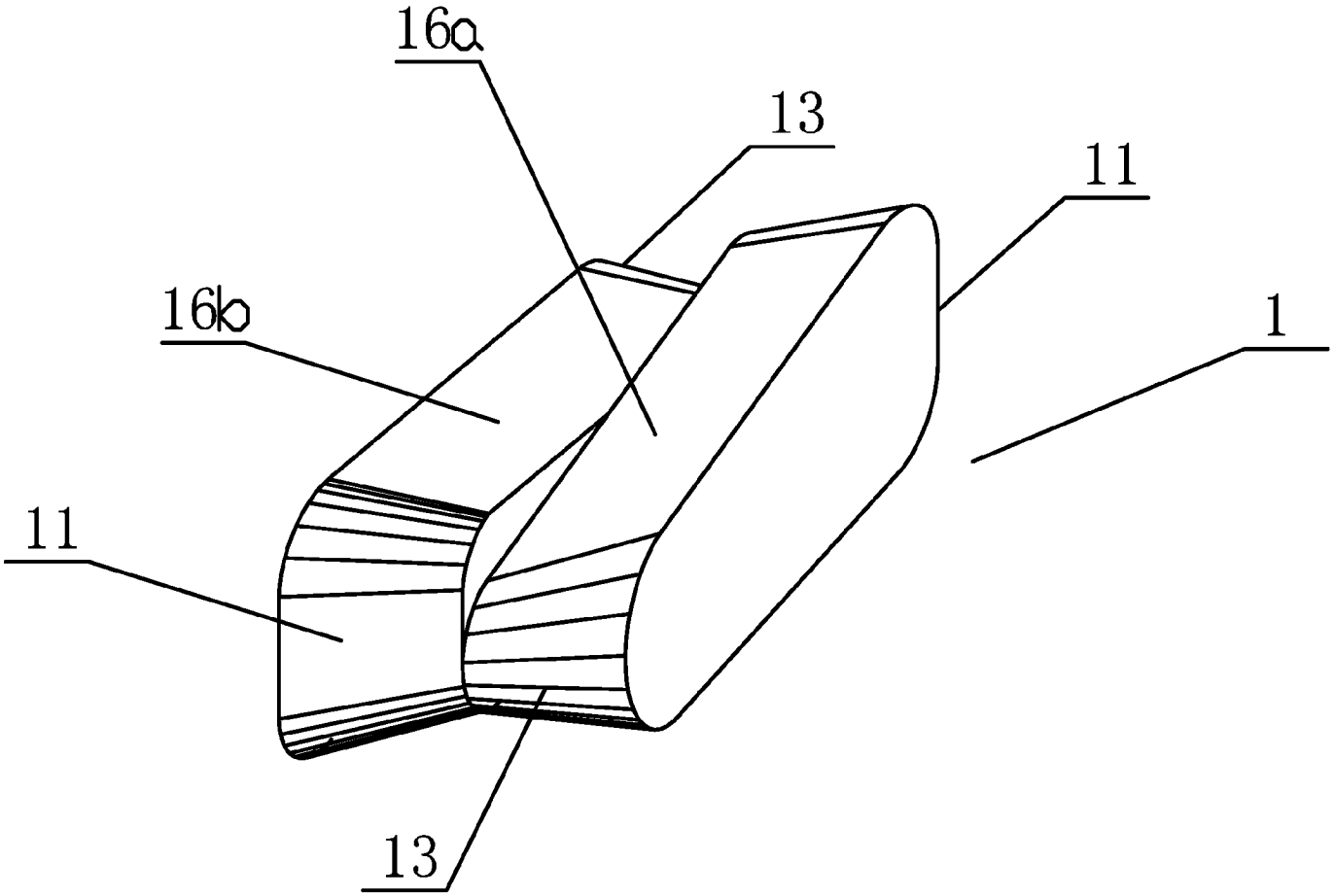
FIG. 28 is a structure diagram of a dovetail beveled tenon in accordance with one embodiment of the invention.
Figure 29:
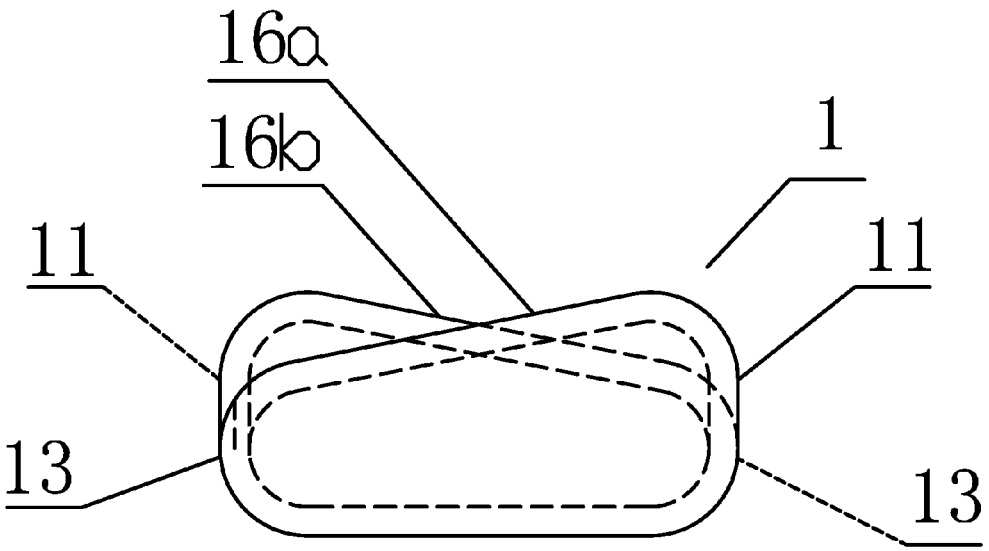
FIG. 29 is a lateral view of a dovetail beveled tenon of FIG. 7 in accordance with one embodiment of the invention.
Figure 30:
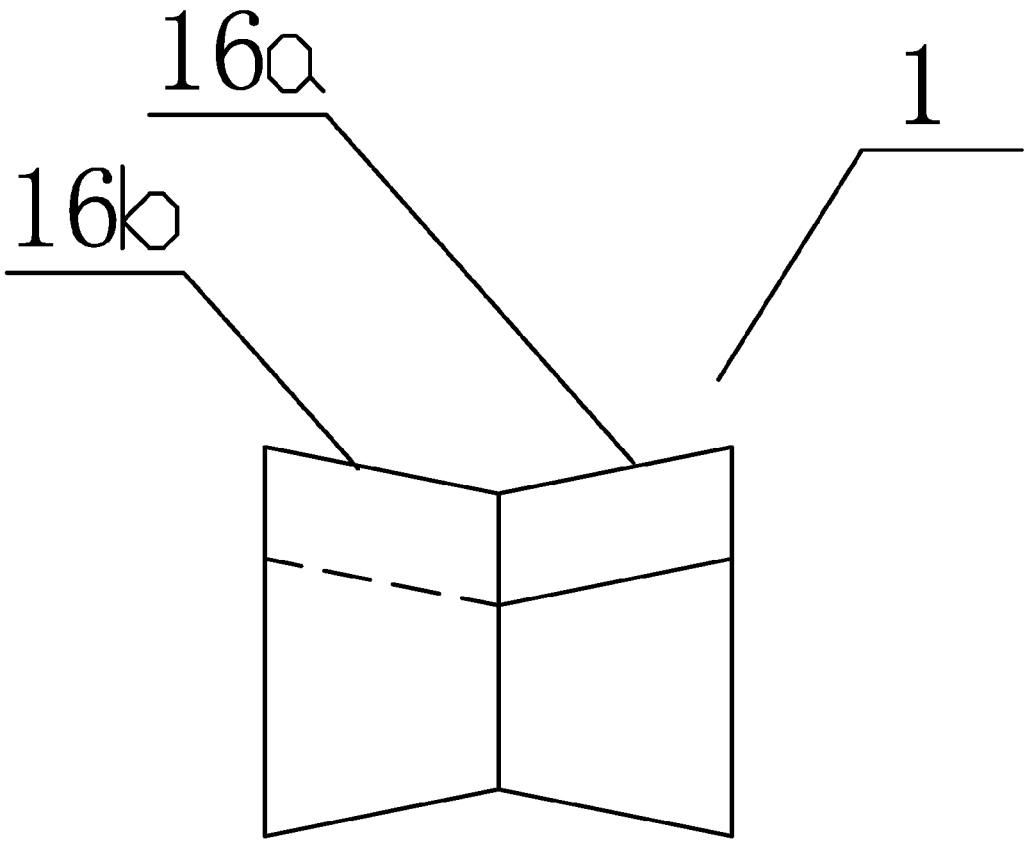
FIG. 30 is a front view of a dovetail beveled tenon of FIG. 7 in accordance with one embodiment of the invention.
Figure 31:
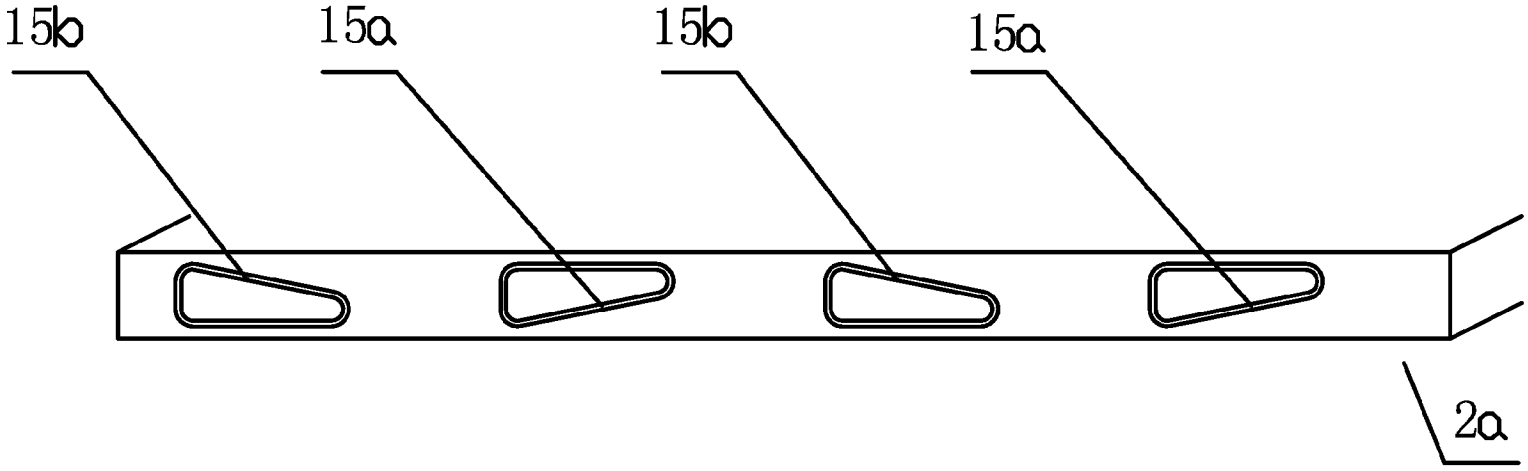
FIG. 31 is a structure diagram of a connecting member comprising a groove fitting with a dovetail beveled tenon in accordance with one embodiment of the invention.
Figure 32:
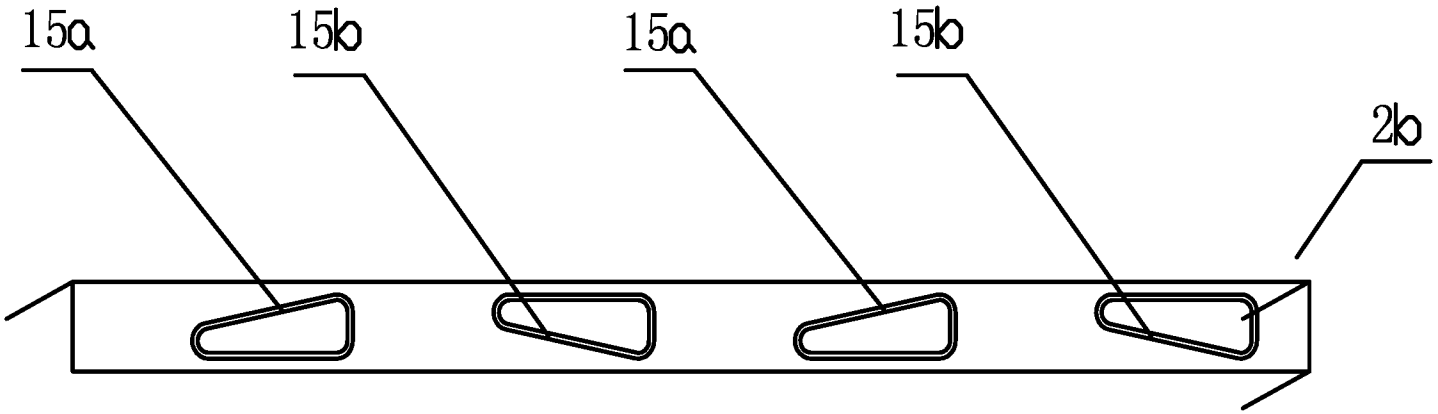
FIG. 32 is a structure diagram of another connecting member comprising a groove fitting with a dovetail beveled tenon in accordance with one embodiment of the invention.
Figure 33:
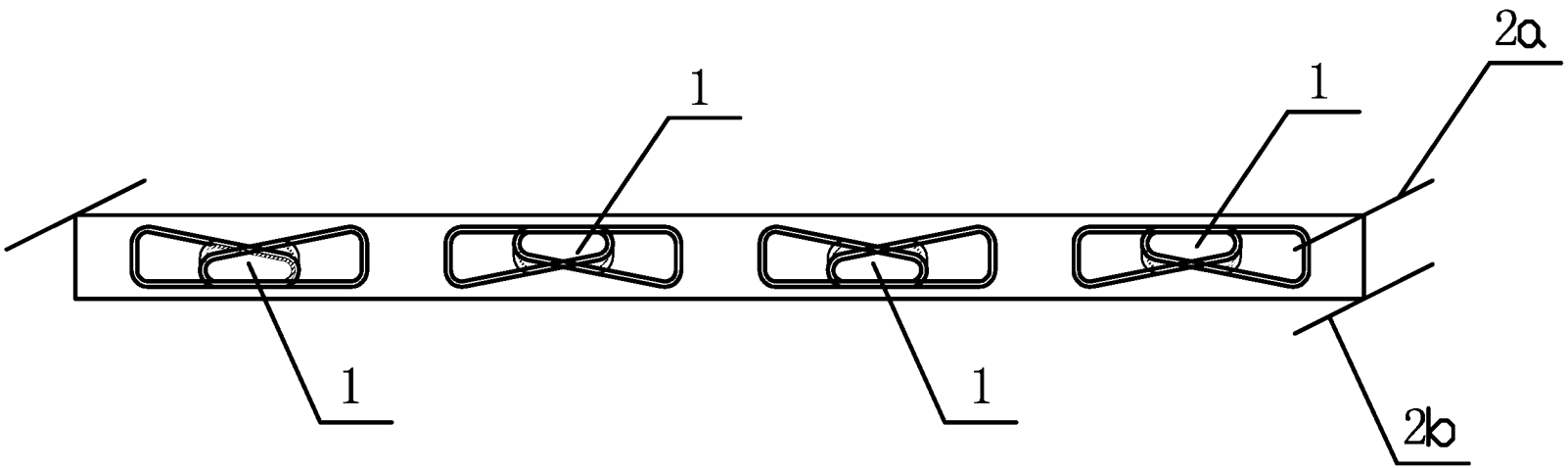
FIG. 33 is a structure diagram of connecting members of FIGS. 31-32 assembled.
Figure 34:
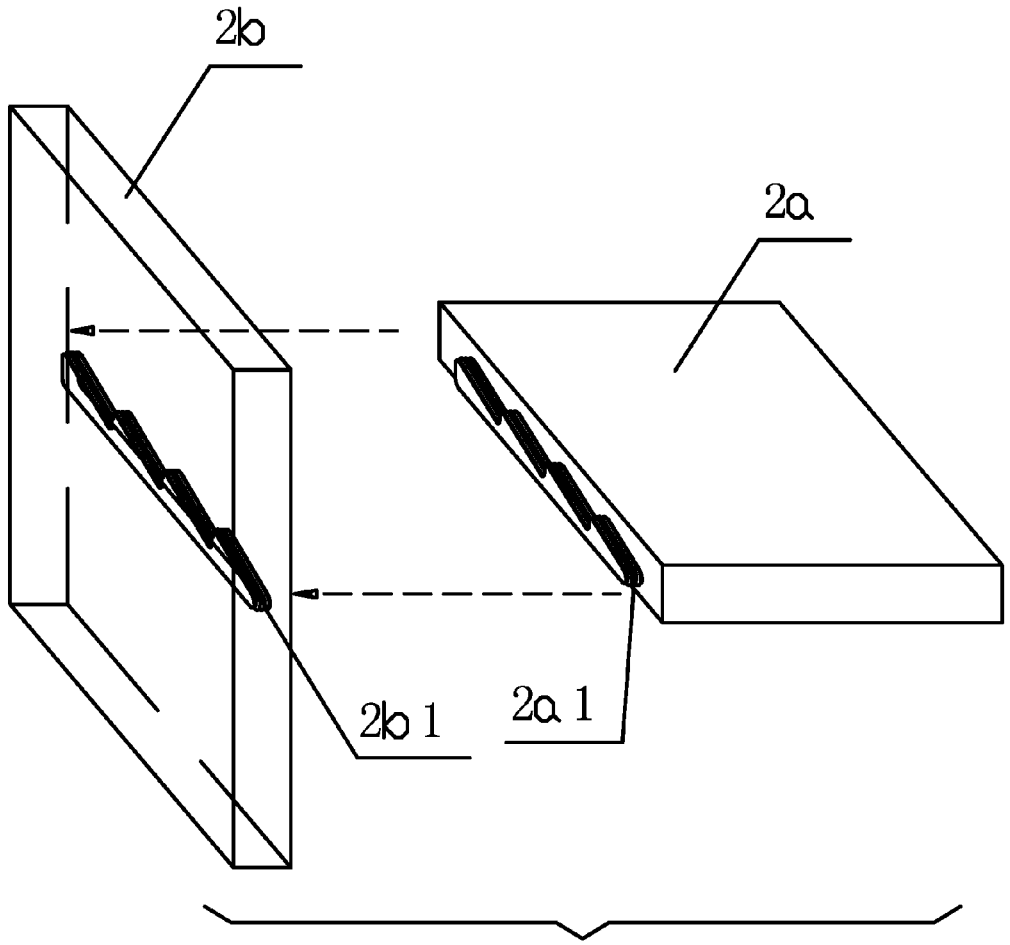
FIG. 34 is a an axonometric drawing of connecting members comprising a plurality of tenons and mortises before assembly in accordance with one embodiment of the invention.
Figure 35:
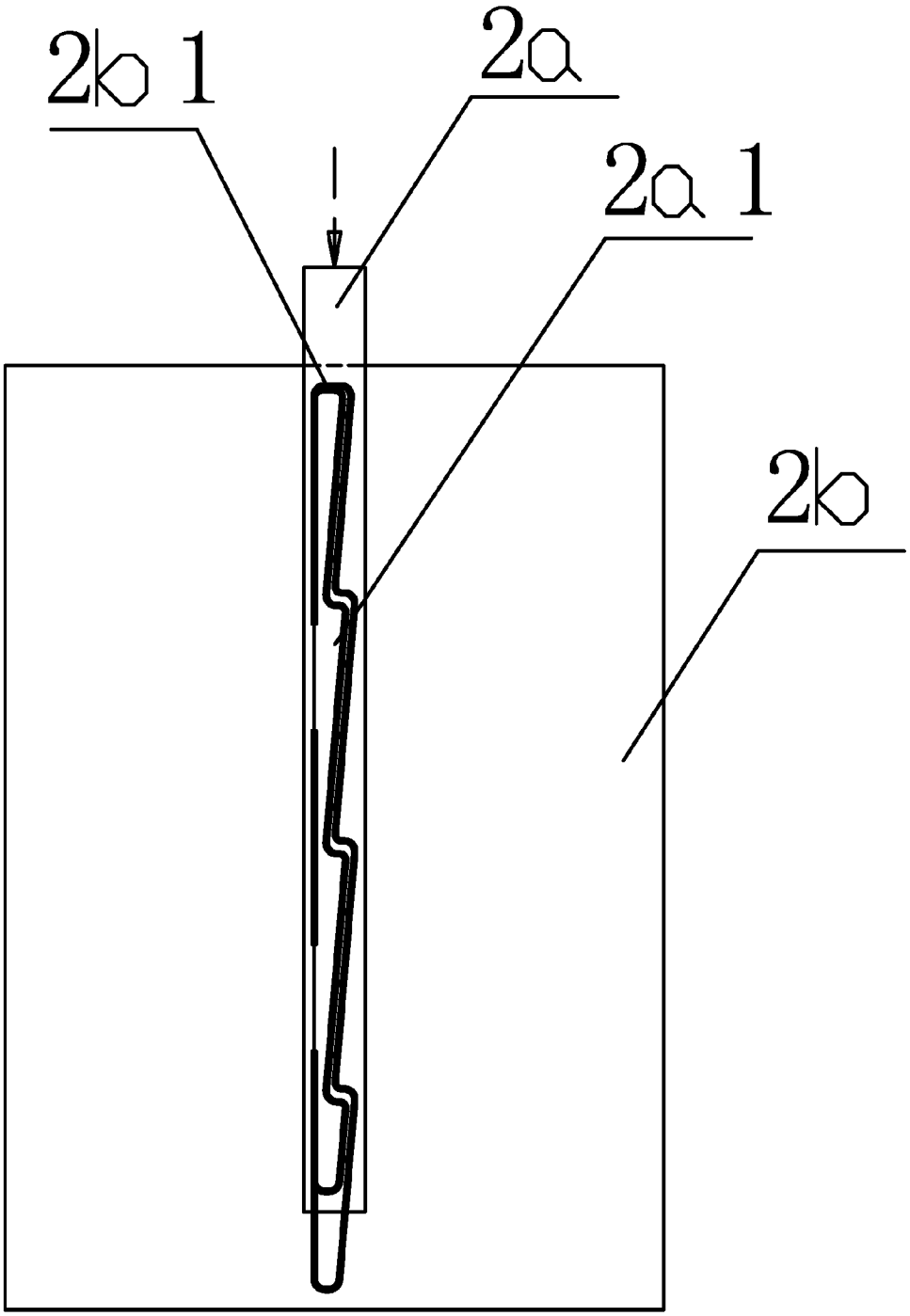
FIG. 35 is a top view of two connecting members comprising reversed straight angle tenons in assembly in accordance with one embodiment of the invention.
Figure 36:
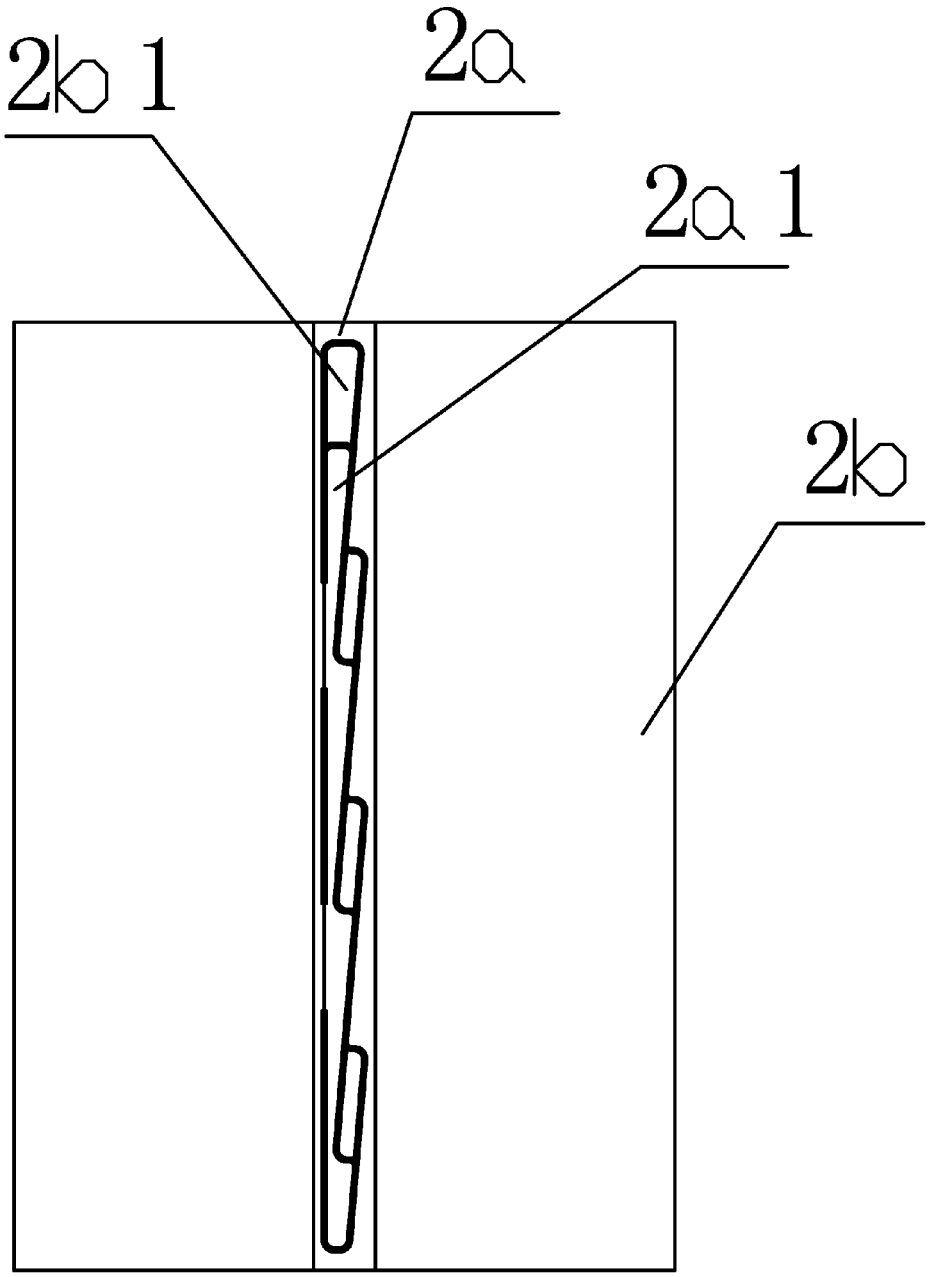
FIG. 36 is a op view of two connecting members comprising reversed straight angle tenons in assembly in accordance with one embodiment of the invention.

The joint of the invention can also used to assemble planks, a structure diagram of planks comprising beveled tenon-and-mortise joints before assembly is shown in FIG. 15. FIG. 16 is a structure diagram of planks comprising beveled tenon-and-mortise joints after assembly. FIG. 17 is a top view of planks comprising beveled tenon-and-mortise joints after assembly.

Another joint structure for a floorboard, comprises: at least one first curved tenon 29, the first curved tenon 29 comprising a tenon face facing outwards; a first curved mortise 30, the first curved mortise 30 comprising a mortise face facing outwards; at least one second curved tenon 29, the second curved tenon 29 comprising a tenon face facing outwards; and a second curved mortise 30, the second curved mortise 30 comprising a mortise face facing outwards. The first curved tenon 29 is disposed inclined to a surface of the floorboard at a right edge approximately half a height of the floorboard; the first curved mortise 30 is disposed at an inner side of the first curved tenon 29. The second curved tenon 29 is disposed at a left edge approximately half the height of the floorboard; the second curved mortise 30 is disposed at an inner side of the second curved tenon 29. The first curved tenon 29 matches with the second curved mortise 30. The second curved tenon 29 matches with the first curved mortise 30. An outer side of the first curved tenon 29 and an inner side of the second curved mortise 30 form a first interlock mechanism. An outer side of the second curved tenon 29 and an inner side of the first curved mortise 30 form a second interlock mechanism. In assembling, the first curved tenon 29 and the first curved mortise 30 of a first floorboard 1 match with the second curved mortise 30 and the second curved tenon 29 of a second floorboard 2, respectively; and the two floorboards are further interlocked by the first interlock mechanism and the second interlock mechanism.

Figure 37:
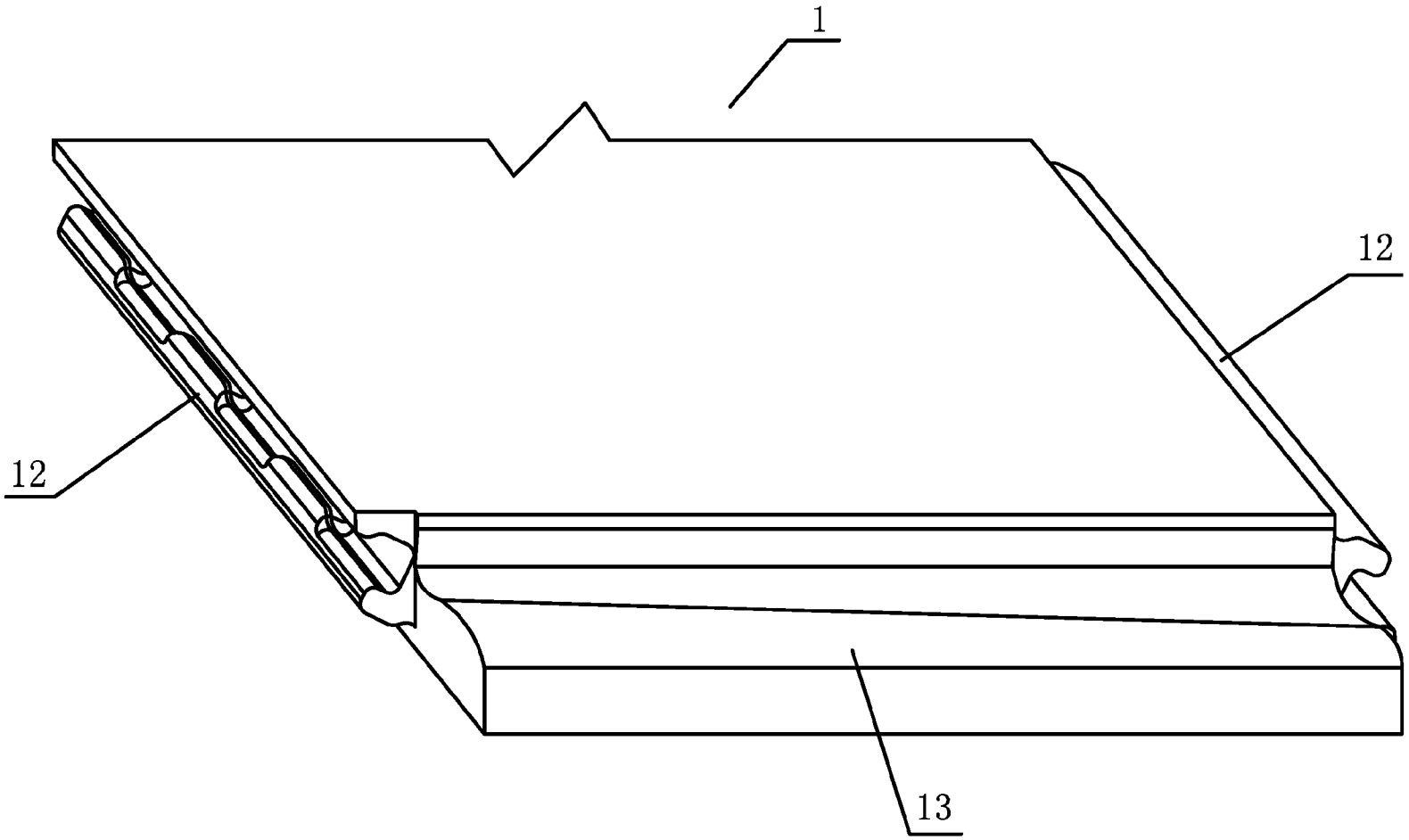
FIG. 37 is a structure diagram of a floorboard combined with a curved tenon-and-mortise joint 12 and a tapered tenon-and-mortise joint 13 in accordance with one embodiment of the invention.

Herein a composite floorboard (as shown in FIG. 37) comprising the curved tenon-and-mortise joint 12 and a tapered tenon-and-mortise joint 13 are described.

Figure 44:
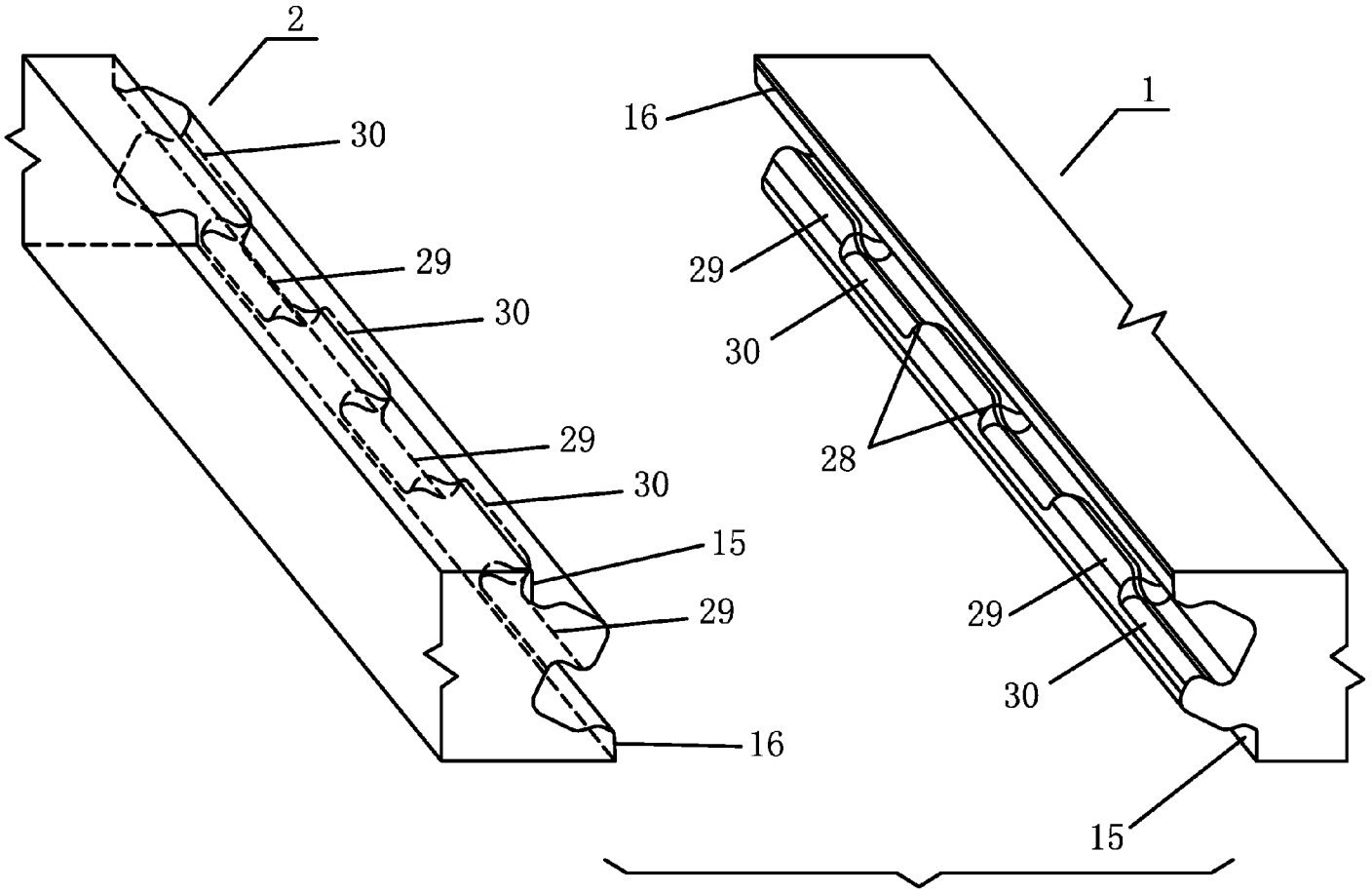
FIG. 44 is a structure diagram of a curved tenon-and-mortise joint before assembly in accordance with one embodiment of the invention.
Figure 45:
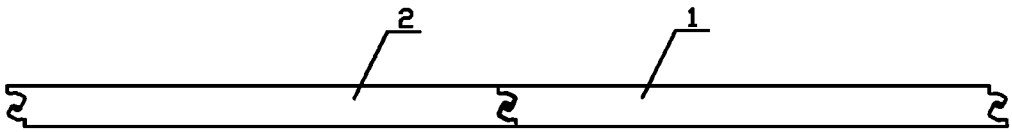
FIG. 45 is a cross section view of a curved tenon-and-mortise joint after assembly in accordance with one embodiment of the invention.
Figure 46:
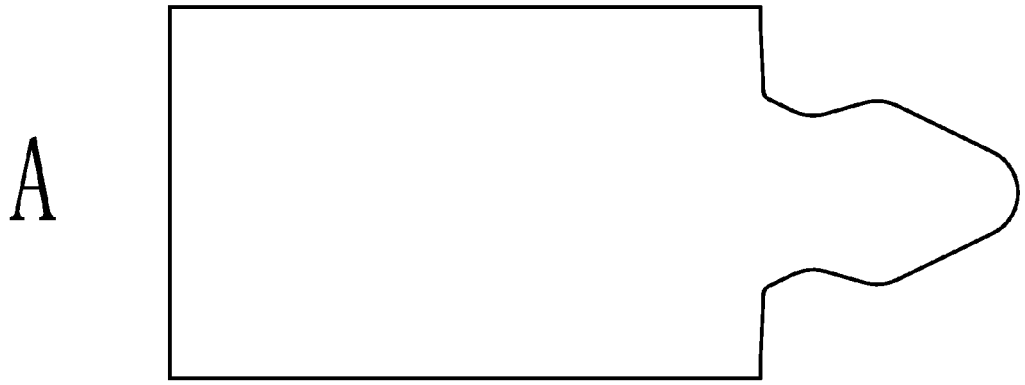
FIGS. 46-50 are structure diagrams of milling cutters of different shapes for machining a curved tenon-and-mortise joint; in accordance with one embodiment of the invention.
Figure 47:
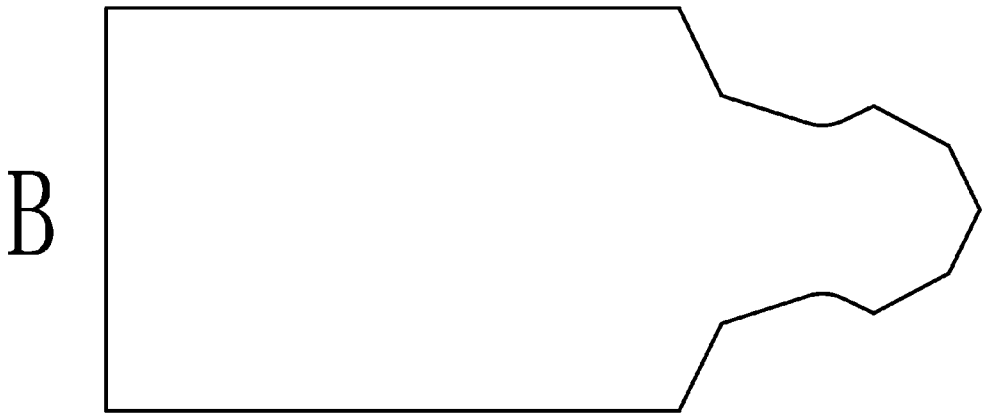
Figure 48:
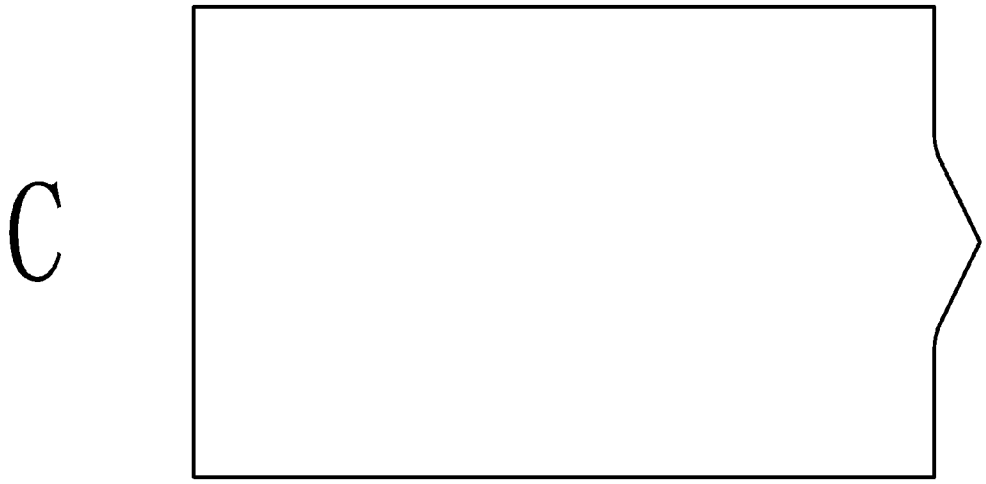
Figure 49:
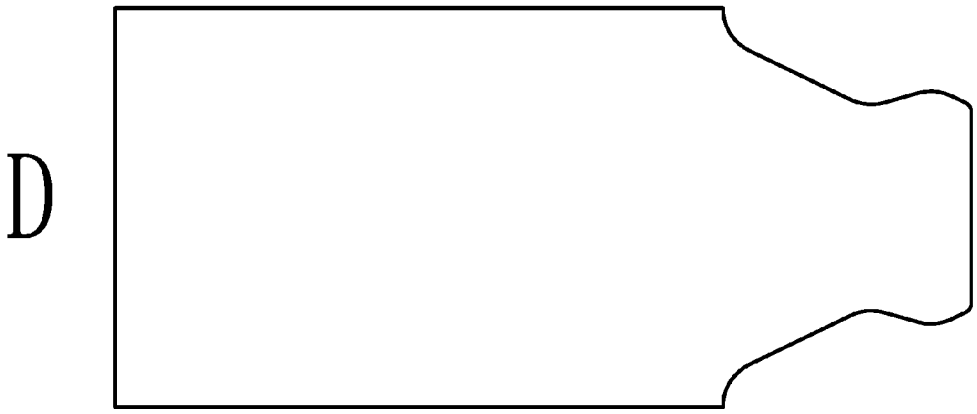
Figure 50:
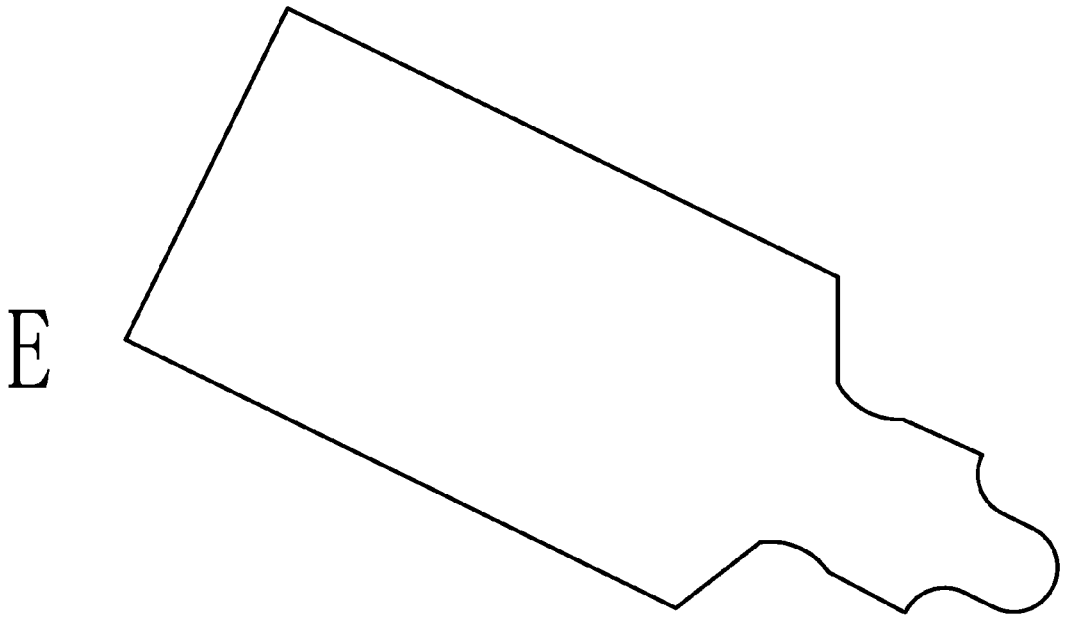

The curved tenon-and-mortise joint as shown in FIG. 44 comprises: a curved tenon 29 and a curved mortise 30, auxiliary matching structures comprising a stitching tenon 16 and a stitching mortise 15, and a curved corner 28.

Figure 38:
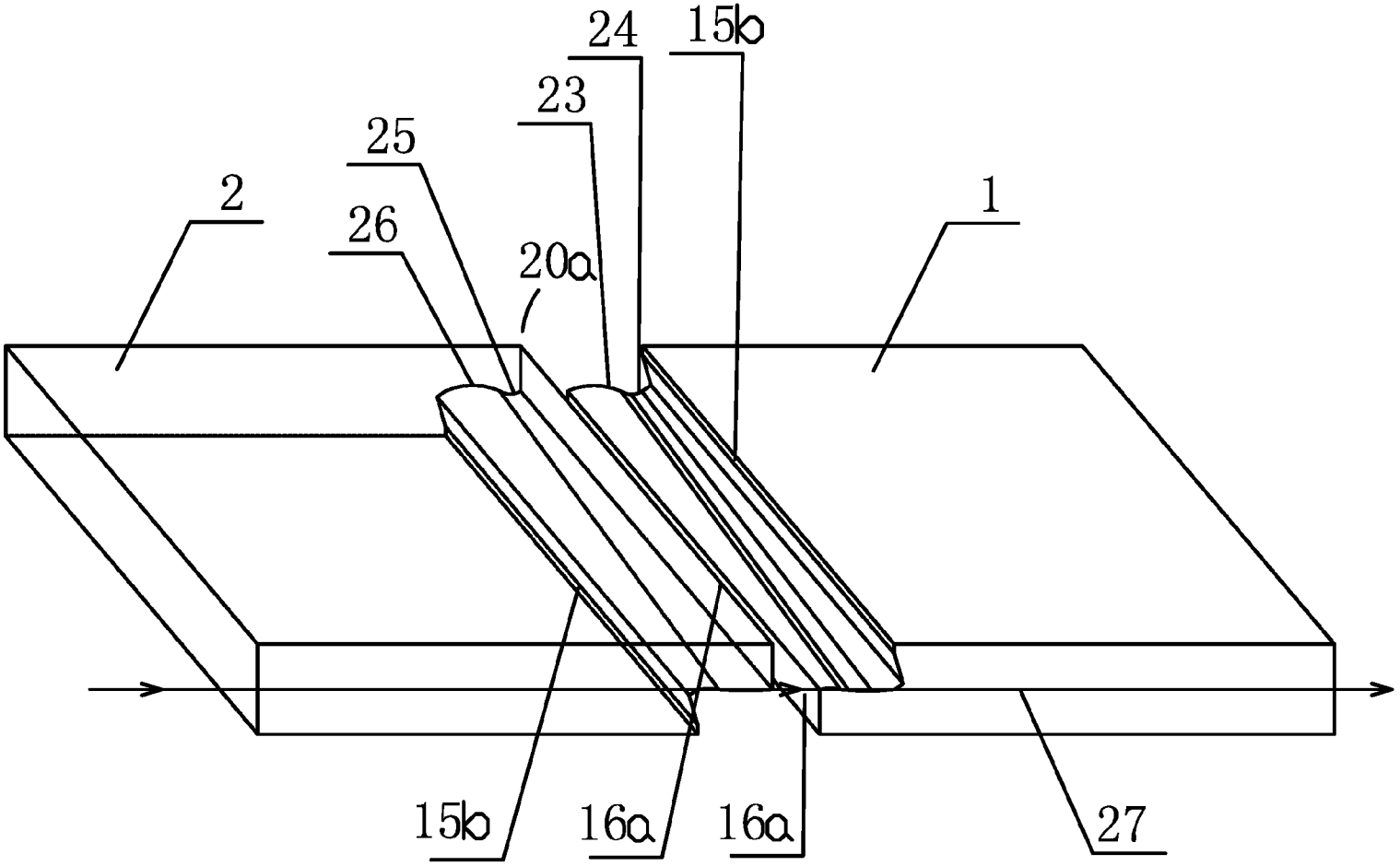
FIG. 38 is a structure diagram of floorboards comprising a tapered tenon-and-mortise joint before assembly in accordance with one embodiment of the invention.

The tapered tenon-and-mortise joint 13 (as shown in FIG. 38) comprises: a tapered tenon 23, 25 and a tapered mortise 24, 26, and an auxiliary matching structure comprising a stitching tenon 16*a* and a stitching mortise 15*b*.

Floorboards employing the two kinds of joints are superior to those employing the same tenon-and-mortise joints but totally different from those conventional ones employing different tenon-and-mortise joints. The curved tenon-and-mortise joint as shown in FIG. 44 has a smaller space of 5 mm compared to the conventional joints of 12 mm. The finished product rate exceeds two times of that of the conventional ones, thereby largely improving the finished product rate of the floorboards. Furthermore, the floorboards after being assembled have sealed joints and high integration and strength. Because the two floorboards have the same tenon-and-mortise joints on the same side, the assembly and disassembly of the floorboards are very convenient.

Figure 39:
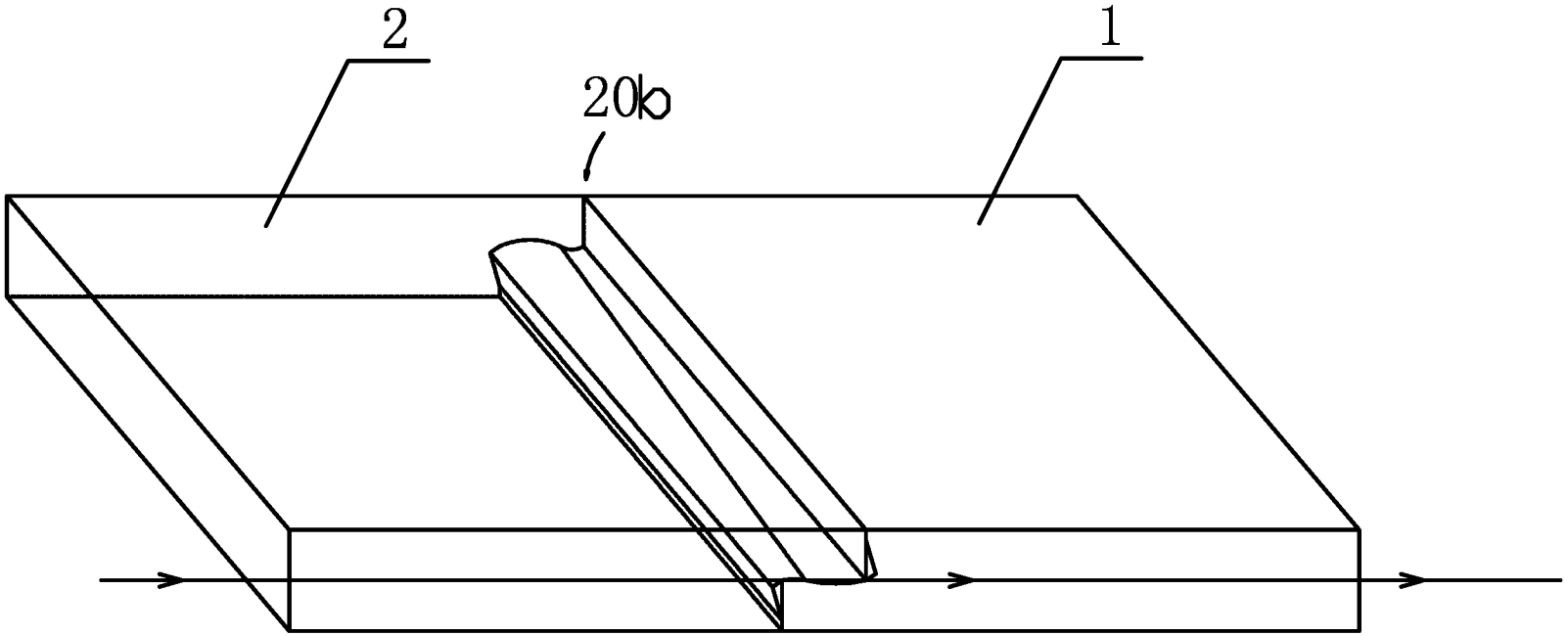
FIG. 39 is a structure diagram of floorboards comprising a tapered tenon-and-mortise joint after assembly in accordance with one embodiment of the invention.
Figure 40:
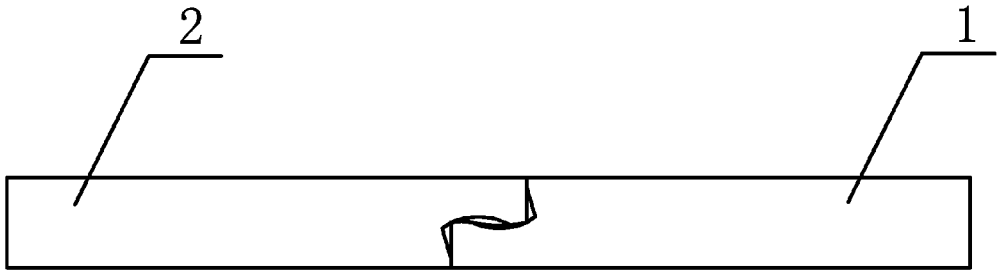
FIG. 40 is a cross section view of an assembled tapered tenon-and-mortise joint.

The tapered tenon-and-mortise joint as shown in FIGS. 38-39 is assembled by a method of unilateral axis rotating, which obviously different from the conventional stitching principles. The assembly of the tapered tenon-and-mortise joint is realized by slight deformation. The tapered tenon-and-mortise joint of the invention has a much simpler structure, no obvious grooves, and high integration and strength.

Figure 41:
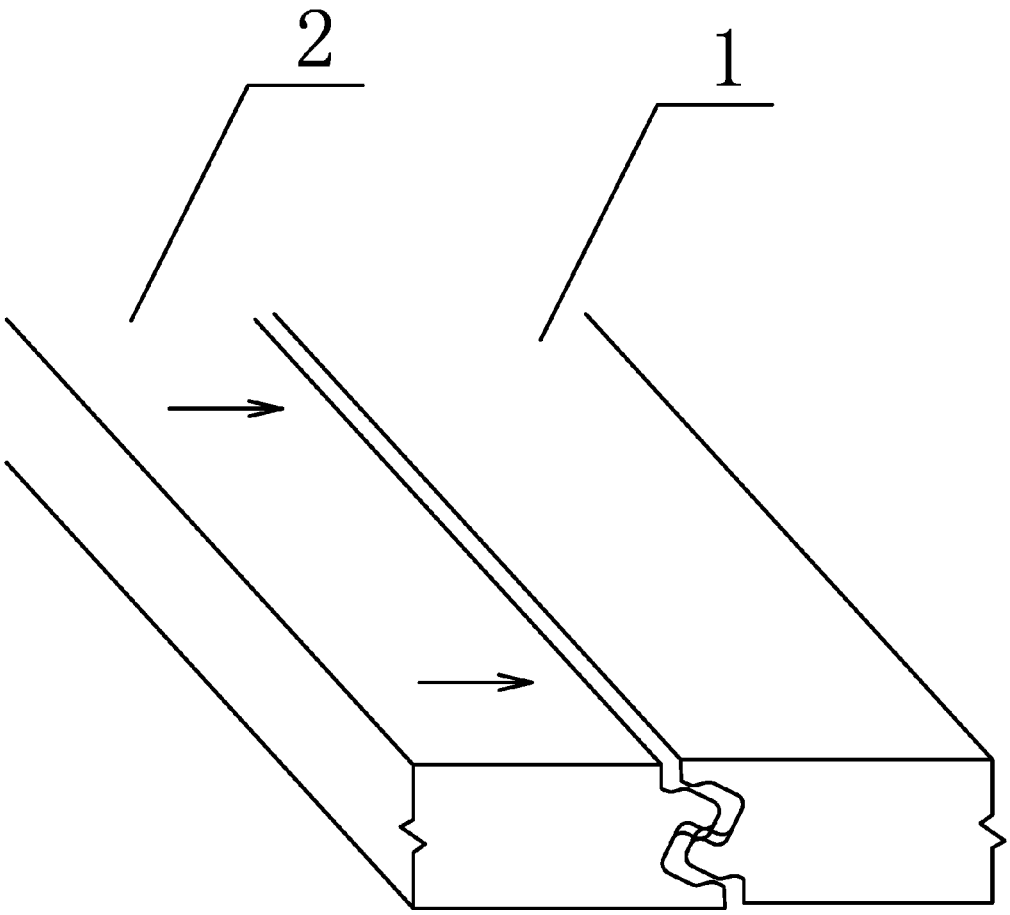
FIG. 41 is a first installation diagram of floorboards comprising a curved tenon-and-mortise joint in accordance with one embodiment of the invention.
Figure 42:
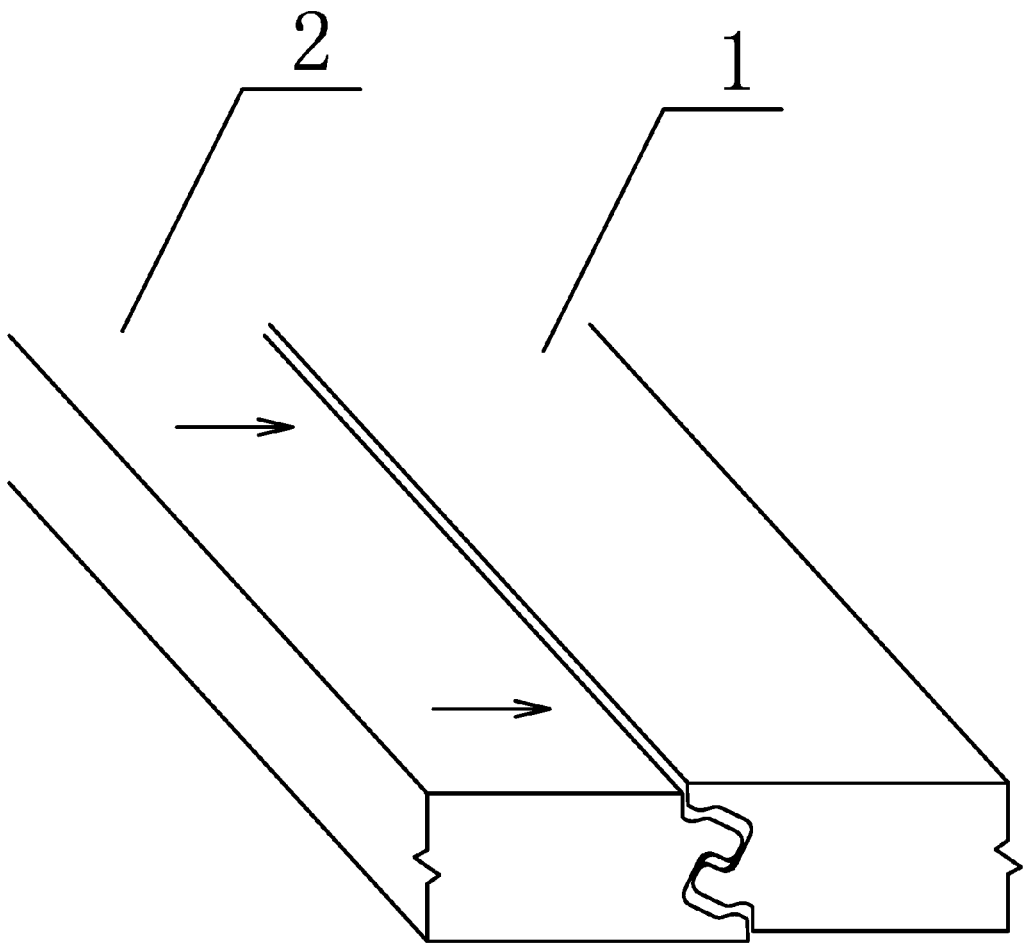
FIG. 42 is a second installation diagram of floorboards comprising a curved tenon-and-mortise joint in accordance with one embodiment of the invention.
Figure 43:
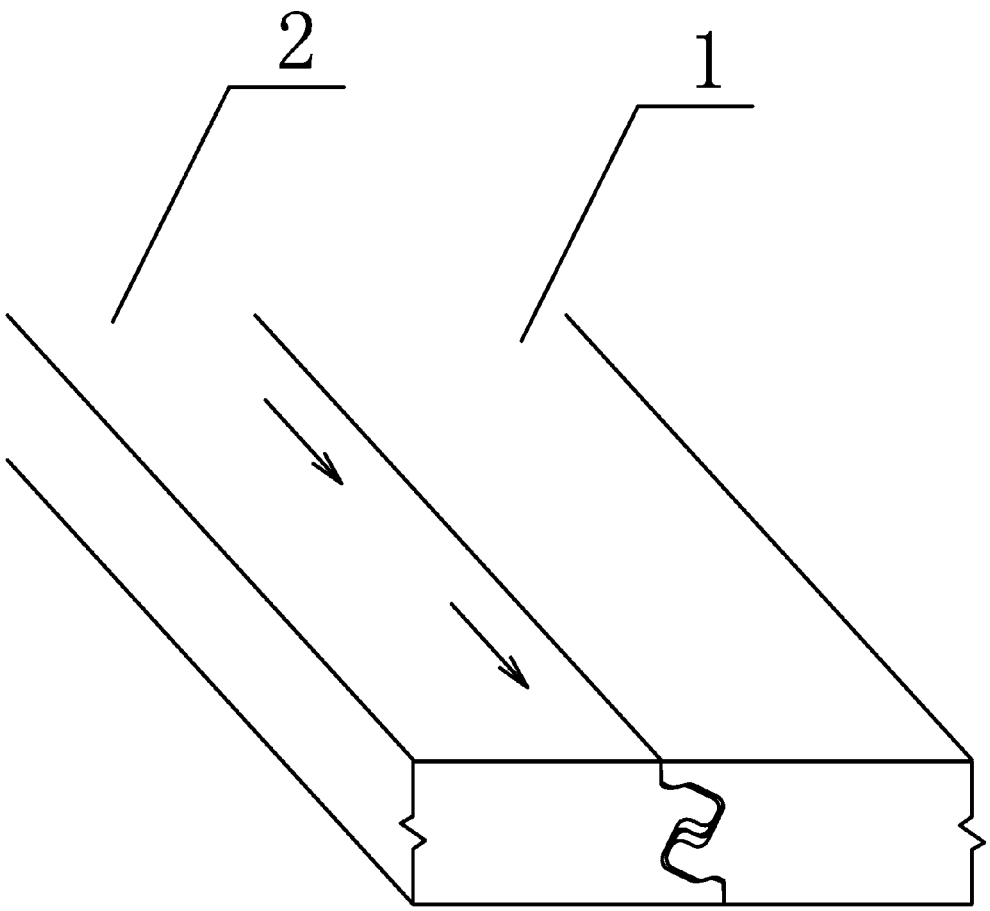
FIG. 43 is a second installation diagram of floorboards comprising a curved tenon-and-mortise joint in accordance with one embodiment of the invention.

Process for assembling composite floorboard comprising the curved tenon-and-mortise joint 12 and the tapered tenon-and-mortise joint 13 is as follows: place the curved tenon 29 of a first floorboard into the curved mortise 30 of another floorboard. Move the two floorboards in opposite directions along a stitching line to match with each other. Move in horizontal direction after being lifted by two curved corners 28, control a horizontal movement within a range of the curved tenon 29 (that is, a width of a conventional expansion joint of floor corner is approximately 5 mm) Process for joint the curved tenon and the curved mortise are shown in FIGS. 41-43. Match the tapered tenon-and-mortise joint while moving, using the matching curved tenon-and-mortise joint as an axis to lifting the curved tenon-and-mortise joint of an opposite end. The match of the curved tenon-and-mortise joint realizes the stitching of the stitching tenon 16 and the stitching mortise 15 during which the tapered tenon-and-mortise joint moves downwards to realize the stitching of the stitching tenon 16*a* and a stitching mortise 15*b*, as shown in FIGS. 38-39. Thus, the assembling composite floorboard comprising the curved tenon-and-mortise joint 12 and the tapered tenon-and-mortise joint 13 are finished.

Figure 51:
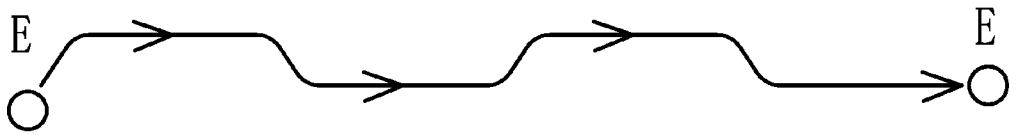
FIG. 51 is a machining path of a milling cutter of shape E in accordance with one embodiment of the invention.
Figure 52:
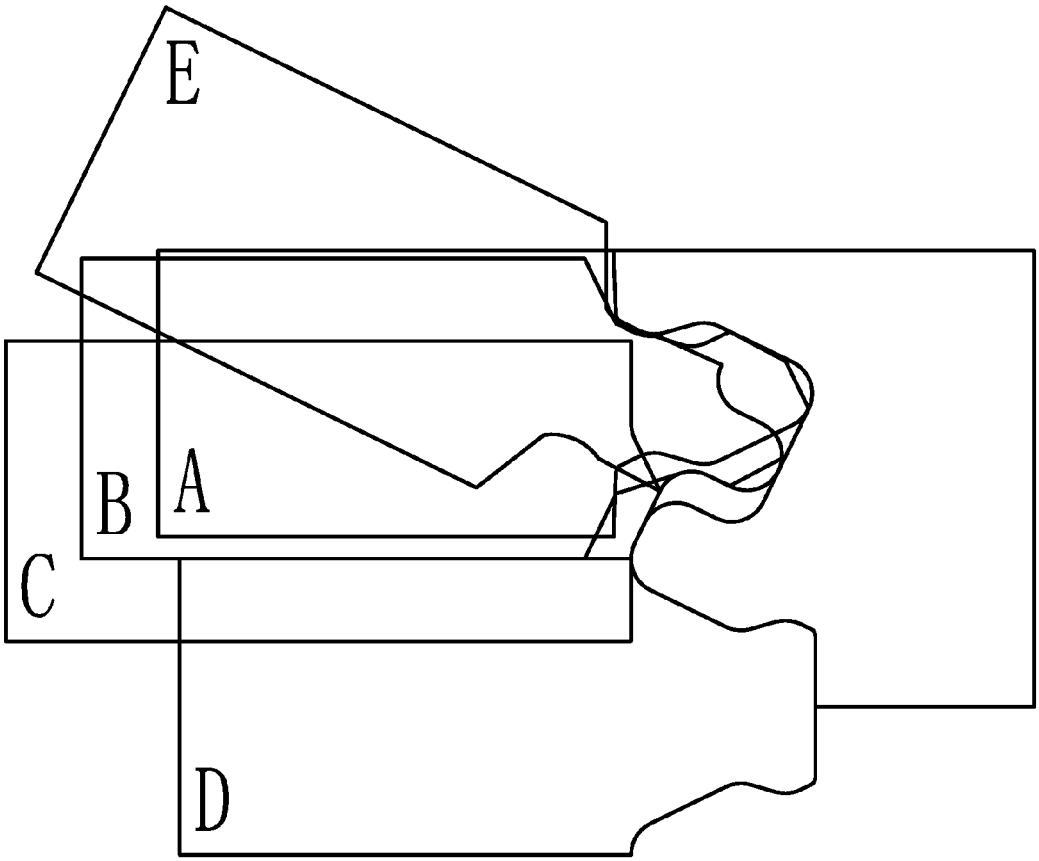
FIG. 52 is a structure diagram of different milling cutters shaping different positions of a curved tenon-and-mortise joint in accordance with one embodiment of the invention.
Figure 53:
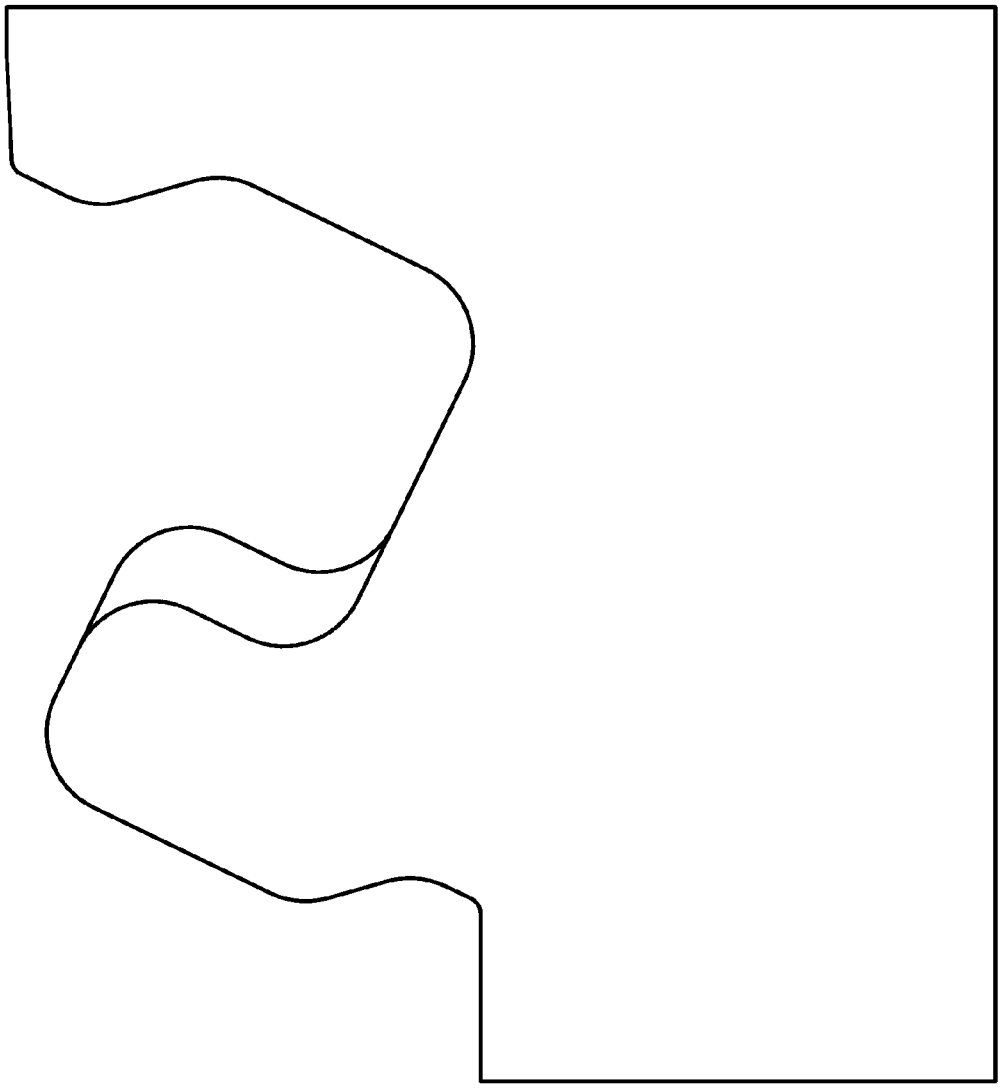
FIG. 53 is a structure diagram of a finished curved tenon-and-mortise joint in accordance with one embodiment of the invention.
Figure 54:
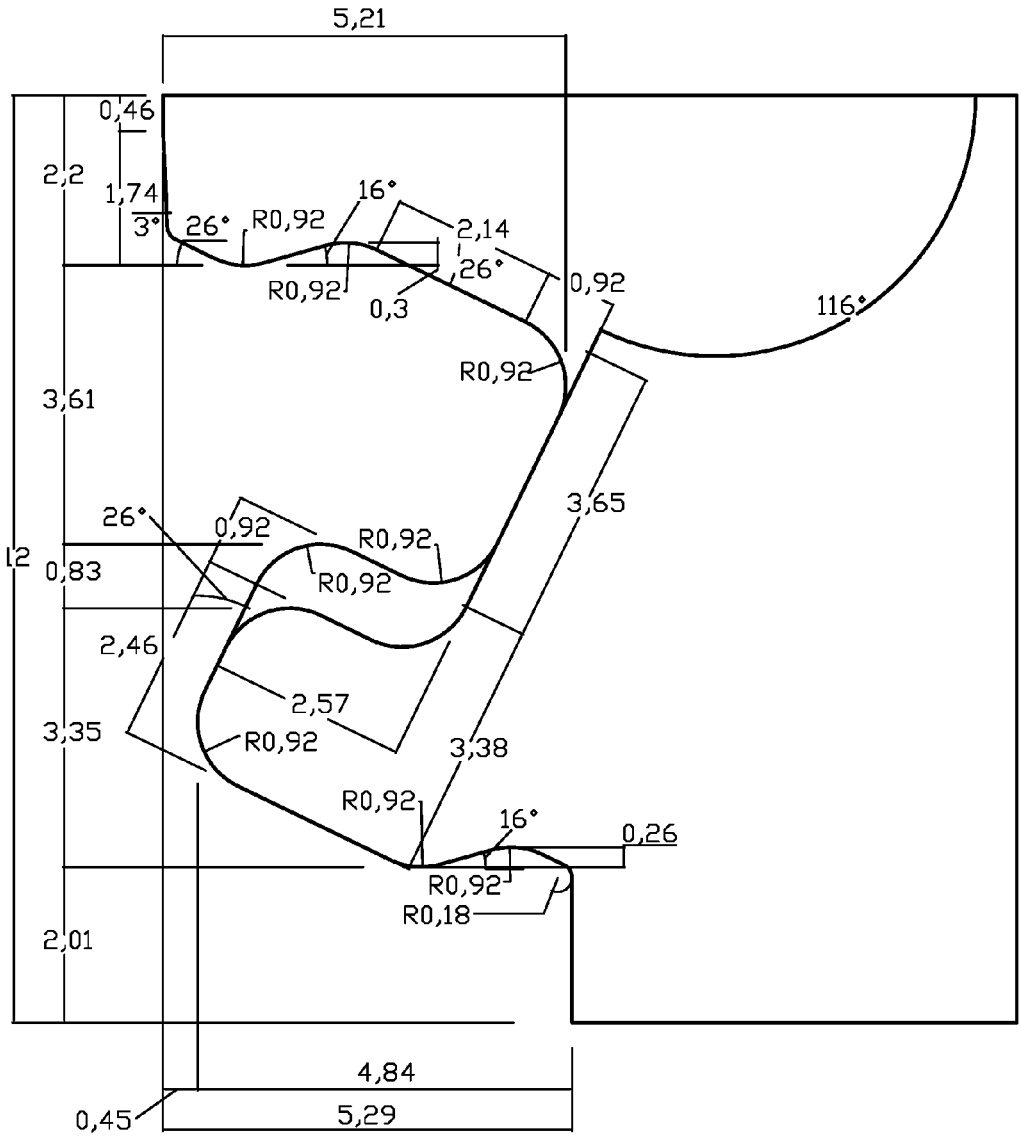
FIG. 54 is a structure diagram of a curved tenon-and-mortise joint with specific dimensions in accordance with one embodiment of the invention.

FIGS. 46-50 are structure diagrams of milling cutters of different shapes for machining a curved tenon-and-mortise joint. FIG. 52 is a structure diagram of different milling cutters shaping different positions of a curved tenon-and-mortise joint. A machining path of a milling cutter of shape E is shown in FIG. 51. Machining paths of other milling cutters of different shapes (such as shape A, shape B, shape C, and shape D) are straight lines. FIG. 53 is a structure diagram of a finished curved tenon-and-mortise joint. FIG. 54 is a structure diagram of a curved tenon-and-mortise joint with specific dimensions.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A joint structure comprising structure comprising a first floorboard and a second floorboard, the first floorboard and the second floorboard each comprising:

a) a top surface;

b) a bottom surface;

c) a first side surface;

d) a second side surface;

e) a third side surface;

f) a fourth side surface;

g) a first beveled tenon, the first beveled tenon comprising a first tenon face, a first-tenon inner side, and a first-tenon outer side; the first-tenon outer side comprising a first-tenon base face that is substantially perpendicular to the first tenon face, and a first trapezoidal tenon that is extended outward from the first-tenon base face, the first trapezoidal tenon comprising a first ridge having a first ridge top;

h) a first beveled mortise, the first beveled mortise comprising a first mortise face and a first-mortise inner side; and the first-mortise inner side comprising a first-mortise base face that is substantially perpendicular to the first mortise face, and a first trapezoidal blind mortise that is extended inward from the first-mortise base face;

i) a second beveled tenon, the second beveled tenon comprising a second tenon face, a second-tenon inner side, and a second-tenon outer side; the second-tenon outer side comprising a second-tenon base face that is substantially perpendicular to the second tenon face, and a second trapezoidal tenon that is extended outward from the second-tenon base face, the second trapezoidal tenon comprising a second ridge having a second ridge top; and j) a second beveled mortise, the second beveled mortise comprising a second mortise face and a second-mortise inner side; and the second-mortise inner side comprising a second mortise base face that is substantially perpendicular to the second mortise face, and a second trapezoidal blind mortise that is extended inward from the second-mortise base face;

wherein:

the top surface is disposed substantially parallel to the bottom surface;

the first side surface, the second side surface, the third side surface, and the fourth side surface are disposed substantially perpendicular to the bottom surface;

the first side surface is disposed opposite to the second side surface;

the third side surface is disposed opposite to the fourth side surface;

the third side surface connects between the first side surface and the second side surface;

the fourth side surface connects between the first side surface and the second side surface;

the first beveled tenon is disposed in parallel with the bottom surface and is disposed on the first side surface at approximately half a height of the first floorboard or the second floorboard;

the first beveled mortise is disposed at the first-tenon inner side;

the second beveled tenon is disposed on the second side surface at approximately half the height of the first floorboard or the second floorboard;

the second beveled mortise is disposed at the second-tenon inner side;

the first beveled tenon is adapted to fit with the second beveled mortise;

the second beveled tenon is adapted to fit with the first beveled mortise;

the first tenon face, the first mortise face, the second tenon face, and the second mortise face are disposed substantially parallel to the top surface;

the first ridge top is a line segment, and the second ridge top is a line segment;

the first-tenon outer side of the first floorboard and the second-mortise inner side of the second floorboard are adapted to form a first interlock mechanism;

the second-tenon outer side of the second floorboard and the first-mortise inner side of the first floorboard are adapted to form a second interlock mechanism; and when assembled:

the first beveled tenon and the first beveled mortise of the first floorboard match with the second beveled mortise and the second beveled tenon of the second floorboard, respectively; and the first floorboard and the second floorboard are further interlocked by the first interlock mechanism and the second interlock mechanism;

the second trapezoidal tenon in the second floorboard extends into the first trapezoidal blind mortise in the first floor board; the second ridge top in the second floorboard abuts against the first trapezoidal blind mortise in the first floorboard along a line on the first trapezoidal blind mortise in the first floorboard, and the second-tenon base face in the second floorboard except for the second ridge top is spatially separated from the first-mortise base face in the first floor board; and the first trapezoidal tenon in the first floorboard extends into the second trapezoidal blind mortise in the second floor board; the first ridge top in the first floorboard abuts against the second trapezoidal blind mortise in the second floorboard along a line on the second trapezoidal blind mortise in the second floorboard, and the first-tenon base face in the first floorboard except for the first ridge top is spatially separated from the second-mortise base face in the second floor board.

2. The joint structure of claim 1, wherein the first beveled tenon and the second beveled tenon have the same slope.

* * * * *